US009966017B2

(12) United States Patent
Yamazaki

(10) Patent No.: US 9,966,017 B2
(45) Date of Patent: May 8, 2018

(54) ELECTROPHORETIC APPARATUS AND ELECTRONIC DEVICE HAVING A PIXEL CIRCUIT WITH A PLURALITY OF DRIVING TRANSISTORS AND A PLURALITY OF SELECTION TRANSISTORS

(71) Applicant: Seiko Epson Corporation, Tokyo (JP)

(72) Inventor: Katsunori Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 138 days.

(21) Appl. No.: 14/625,416

(22) Filed: Feb. 18, 2015

(65) Prior Publication Data

US 2015/0255020 A1 Sep. 10, 2015

(30) Foreign Application Priority Data

Mar. 7, 2014 (JP) ..... 2014-045633
Dec. 12, 2014 (JP) ..... 2014-251917

(51) Int. Cl.
*G09G 5/00* (2006.01)
*G09G 3/34* (2006.01)

(52) U.S. Cl.
CPC ..... *G09G 3/344* (2013.01); *G09G 2300/0804* (2013.01); *G09G 2300/0842* (2013.01); *G09G 2310/06* (2013.01); *G09G 2320/0209* (2013.01)

(58) Field of Classification Search
CPC ..... G09G 3/344; G09G 3/3659; G09G 2300/0809–2300/0833; G09G 2310/0262; G09G 3/30–3/3291
See application file for complete search history.

(56) References Cited

U.S. PATENT DOCUMENTS 6,531,997 B1 * 3/2003 Gates ..... G02F 1/167 204/606
8,274,472 B1 * 9/2012 Wang ..... G09G 3/344 345/107
2002/0018029 A1 * 2/2002 Koyama ..... G09G 3/3275 345/39
2004/0036683 A1 * 2/2004 Senda ..... G09G 3/3233 345/204

(Continued)

FOREIGN PATENT DOCUMENTS

JP 2008-176330 A 7/2008
JP 2012-198406 A 10/2012

*Primary Examiner* — Yuzhen Shen
(74) *Attorney, Agent, or Firm* — ALG Intellectual Property, LLC

(57) ABSTRACT

An electrophoretic apparatus includes a first electrode, a second electrode, an electrophoretic element which is interposed between the first electrode and the second electrode, and a pixel circuit which is connected to a scanning line and a data line, and which includes a first transistor configured to supply a first electric potential to the first electrode, a second transistor configured to supply a second electric potential to the first electric potential, a third transistor configured to supply a third electric potential to the first electrode; a fourth transistor configured to supply a signal supplied through the data line to the first transistor, a fifth transistor configured to supply a signal supplied through the data line to the second transistor, and a sixth transistor configured to supply a signal supplied through the data line to the third transistor.

10 Claims, 13 Drawing Sheets

(56) References Cited

U.S. PATENT DOCUMENTS

| | | | | |
|---|---|---|---|---|
| 2005/0007361 | A1* | 1/2005 | Fujikura | G09G 3/325 345/204 |
| 2005/0068279 | A1 | 3/2005 | Hirota et al. | |
| 2005/0168570 | A1* | 8/2005 | Kim | G09G 3/3659 348/71 |
| 2005/0243079 | A1* | 11/2005 | Ozaki | G09G 3/2022 345/204 |
| 2007/0091035 | A1* | 4/2007 | Osame | G09G 3/2022 345/76 |
| 2007/0164938 | A1* | 7/2007 | Shin | G09G 3/3233 345/76 |
| 2008/0238867 | A1* | 10/2008 | Maeda | G09G 3/344 345/107 |
| 2008/0273022 | A1* | 11/2008 | Komatsu | G09G 3/344 345/205 |
| 2010/0073282 | A1* | 3/2010 | Murayama | G09G 3/3446 345/107 |
| 2010/0079428 | A1* | 4/2010 | Kajino | G09G 3/344 345/208 |
| 2011/0096053 | A1* | 4/2011 | Yamazaki | G09G 3/344 345/211 |
| 2011/0102480 | A1* | 5/2011 | Miyasaka | G04G 9/0005 345/690 |
| 2012/0235977 | A1* | 9/2012 | Yamazaki | G09G 3/344 345/212 |
| 2012/0242642 | A1 | 9/2012 | Yamazaki et al. | |

* cited by examiner

ELECTROPHORETIC APPARATUS AND ELECTRONIC DEVICE HAVING A PIXEL CIRCUIT WITH A PLURALITY OF DRIVING TRANSISTORS AND A PLURALITY OF SELECTION TRANSISTORS

BACKGROUND

1. Technical Field

The present invention relates to an electrophoretic apparatus and an electronic device.

2. Related Art

It is generally known that, when an electric field is applied to dispersion liquid obtained by dispersing electrophoretic particles inside liquid, a phenomenon in which the electrophoretic particles are electrophoresed by a coulomb force (i.e., an electrophoretic phenomenon) occurs, and electrophoretic apparatuses, such as electronic paper, which utilize the electrophoretic phenomenon have been developed.

Such an electrophoretic apparatus includes a plurality of pixel electrodes each disposed so as to be associated with a corresponding one of a plurality of pixels; a common electrode which is disposed so as to face, and be common to, the plurality of pixel electrodes; and electrophoretic particles which are interposed between each of the pixel electrodes and the common electrode. Further, the electrophoretic apparatus gives an electric field difference between a desired one of the pixel electrodes and the common electrode so that electrophoretic particles, which are interposed between the desired one of the pixel electrodes and the common electrode, are driven and electrophoresed by an electric field caused by the electric field difference. Further, a display image, in which states each associated with electrophoretic particles having been electrophoresed by means of such a driving method are reflected, is displayed on the electrophoretic apparatus.

In order to cause such an electrophoretic apparatus to display an image thereon, an image signal is stored into a desired one of memory circuits once via a corresponding switching element. When the image signal having been stored in the memory circuit is directly input to a corresponding pixel electrode and gives electric potential to the pixel electrode, an electric potential difference arises between the pixel electrode and an opposing electrode. Further, this electric potential difference drives a corresponding electrophoretic element; thereby enabling the electrophoretic apparatus to display the image thereon (refer to, for example, JP-A-2008-176330).

In the electrophoretic apparatus according to the aforementioned existing technology, there exists a period when a certain pixel is not supplied with any electric potential, and in this period, the certain pixel is likely to be affected by electric potentials of a pixel electrode corresponding to a pixel adjacent to the certain pixel. Thus, in the electrophoretic apparatus according to the aforementioned existing technology, there has been a problem in that blurring occurs in display of a pixel affected by electric potentials supplied to a pixel electrode corresponding to an adjacent pixel.

SUMMARY

An advantage of some aspects of the invention is that an electrophoretic apparatus and an electronic device are provided, each of which makes it possible to reduce a degree of blurring in display of each pixel.

An electrophoretic apparatus according to an aspect of the invention includes a plurality of pixels each including a first electrode, a second electrode opposite the first electrode, an electrophoretic element which is interposed between the first electrode and the second electrode and which includes a plurality of charged electrophoretic particles, and a pixel circuit which is connected to a scanning line and a data line and gives an electric potential difference between the first electrode and the second electrode, and which includes a first transistor configured to control whether a first electric potential is to be supplied to the first electrode, or not, on the basis of a signal supplied to the first transistor through the data line, a second transistor configured to control whether or not a second electric potential, which is different from the first electric potential, is to be supplied to the first electrode, or not, on the basis of a signal supplied to the second transistor through the data line, a third transistor configured to control whether a third electric potential, which is different from the first electric potential and the second electric potential, is to be supplied to the first electrode, or not, on the basis of a signal supplied to the third transistor through the data line; a fourth transistor configured to control whether a signal supplied to the fourth transistor through the data line is to be supplied to the first transistor, or not, on the basis of a signal supplied to the fourth transistor through the scanning line, a fifth transistor configured to control whether a signal supplied to the fifth transistor through the data line is to be supplied to the second transistor, or not, on the basis of a signal supplied to the fifth transistor through the scanning line, and a sixth transistor configured to control whether a signal supplied to the sixth transistor through the data line is to be supplied to the third transistor, or not, on the basis of a signal supplied to the sixth transistor through the scanning line.

Through this configuration, the electrophoretic apparatus makes it possible for each pixel (each electrophoretic element) to retain electric potentials having been supplied to the each pixel when the each pixel has been selected by the scanning line, even in the state in which the each pixel is not selected by the scanning line. Through this operation, electric potentials of each pixel becomes stable, and thus, the electrophoretic apparatus makes it possible to reduce a degree of a variation of each of the electric potentials of each pixel, which is caused by electric potentials of a pixel adjacent to the each pixel. Thus, the electrophoretic apparatus makes it possible to reduce a degree of blurring in display of each pixel due to a variation of each of the electric potentials of the each pixel, which is caused by electric potentials of a pixel adjacent to the each pixel.

Further, in the above electrophoretic apparatus according to the aspect of the invention, preferably, the first electric potential is an electric potential which, when supplied to the first electrode, causes the electrophoretic particles not to be electrophoresed between the first electrode and the second electrode, the second electric potential is an electric potential which, when supplied to the first electrode, causes electrophoretic particles which constitute the electrophoretic particles and each of which is charged to a positive electric potential to be electrophoresed toward a side of the first electrode, and the third electric potential which, when supplied to the first electrode, causes electrophoretic particles which constitute the electrophoretic particles and each of which is charged to a positive electric potential to be electrophoresed toward a side of the second electrode.

Through this configuration, the electrophoretic apparatus drives each of the electrophoretic elements by using both of positive and negative polarities. Through this operation, the electrophoretic apparatus makes it possible to shorten a period of time required to draw an image because electrophoresis time can be made shorter, as compared with a case where each of the electrophoretic elements is driven by using one of the positive and negative polarities.

Further, in the above electrophoretic apparatus according to the aspect of the invention, preferably, each of the plurality of pixels further includes a first capacitor that, when any signal is not supplied to the first transistor through the data line, retains a gate electric potential of the first transistor; a second capacitor that, when any signal is not supplied to the second transistor through the data line, retains a gate electric potential of the second transistor; and a third capacitor that, when any signal is not supplied to the third transistor through the data line, retains a gate electric potential of the third transistor.

Through this configuration, the electrophoretic apparatus makes it possible for each electrophoretic element to retain its electric potential even in the state in which a pixel corresponding to the each electrophoretic element is not selected by the scanning line. Through this operation, the electrophoretic apparatus makes it possible to continuously electrophorese the electrophoretic particles by scanning a pixel corresponding to the electrophoretic particles once. Thus, the electrophoretic apparatus makes it possible to decrease the number of the scanning operations and, as a result, an amount of electric power consumed by the scanning operations can be reduced.

Further, in the above electrophoretic apparatus according to the aspect of the invention, preferably, the data line includes a first data line, a second data line, and a third data line; the first transistor controls whether the first electric potential is to be supplied to the first electrode, or not, on the basis of a signal supplied to the first transistor though the first data line; the second transistor controls whether the second electric potential is to be supplied to the first electrode, or not, on the basis of a signal supplied to the second transistor through the second data line, and the third transistor controls whether the third electric potential is to be supplied to the first electrode, or not, on the basis of a signal supplied to the third transistor through the third data line.

Through this configuration, the electrophoretic apparatus performs programming of three different electric potentials on each pixel by scanning the each pixel once. Through this operation, the electrophoretic apparatus makes it possible to decrease the number of scanning operations, and thus, an amount of electric power consumed by the scanning operations can be reduced. Further, the electrophoretic apparatus makes it possible to decrease the number of scanning operations, and thus, a period of time required to draw an image can be shortened.

Further, in the above electrophoretic apparatus according to the aspect of the invention, preferably, the signal line includes a first signal line, a second signal line, and a third signal line; the fourth transistor controls whether the signal supplied to the fourth transistor through the data line is to be supplied to the first transistor, or not, on the basis of a signal supplied to the fourth transistor through the first signal line; the fifth transistor controls whether the signal supplied to the fifth transistor through the data line is to be supplied to the second transistor, or not, on the basis of a signal supplied to fifth transistor through the second scanning line, and the sixth transistor controls whether the signal supplied to the sixth transistor through the data line is to be supplied to the third transistor, or not, on the basis of a signal supplied to the sixth transistor through the third scanning line.

Through this configuration, the electrophoretic apparatus performs programming three different electric potentials on each pixel by scanning the each pixel once. Through this operation, the electrophoretic apparatus makes it possible to decrease the number of scanning operations, and thus, an amount of electric power consumed by the scanning operations can be reduced. Further, the electrophoretic apparatus makes it possible to decrease the number of scanning operations, and thus, a period of time required to draw an image can be shortened.

Further, an electronic device according to another aspect of the invention includes any one of the above electrophoretic apparatuses.

Through this configuration, the electronic device makes it possible to reduce a degree of blurring in display of each pixel.

As described above, according to the aspects of the invention, each of the electrophoretic apparatus and the electronic device makes is possible to reduce a degree of blurring in display of each pixel.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment according to the invention will be described in detail with reference to some of the drawings.

Electrophoretic Apparatus

Hereinafter, an embodiment according to the invention will be described with reference to some of the drawings. It is to be noted that this embodiment shows just an embodiment of the invention and does not limit the invention. Further, this embodiment can be optionally changed within a scope of a technical thought of the invention. Further, in drawings below, in order to make it easy to understand individual configurations, reduction scales, the number of components and the like in individual structures are made different from those of actual structures.

Figure 1:
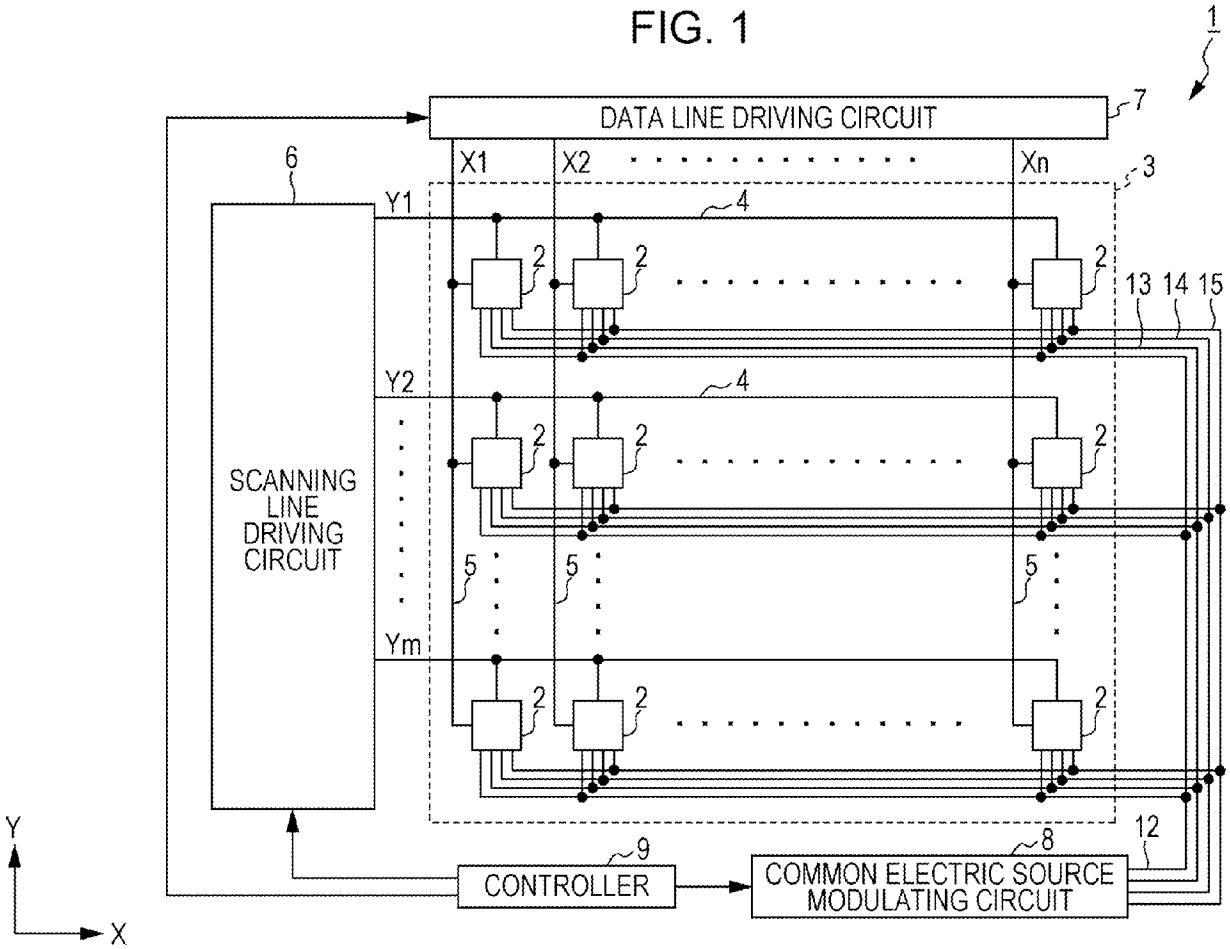
FIG. 1 is a block diagram illustrating an outline of a configuration of an electrophoretic apparatus according to an embodiment of the invention.

FIG. 1 is a block diagram illustrating an outline of a configuration of an electrophoretic apparatus 1 according to this embodiment of the invention. FIG. 1 illustrates an electrophoretic apparatus employing an active matrix method, as an example of this embodiment. The electrophoretic apparatus 1 illustrated in FIG. 1 includes a display portion 3 in which a plurality of pixels 2 are arrayed in the form of a matrix, as well as a peripheral portion of the display portion 3 in which a scanning line driving circuit 6, a data line driving circuit 7, a common electric source modulating circuit 8, and a controller 9 are disposed.

In the display portion 3, the pixels 2 are arrayed such that the number of pixels arrayed along a Y-axis direction is m, and the number of pixels arrayed along an X-axis direction is n. Each of the pixels 2 arrayed inside the display portion 3 is disposed at one of positions where a plurality of scanning lines 4 extending from the scanning line driving circuit 6 and a plurality of data lines 5 extending from the data line driving circuit 7 are intersected with each other.

The scanning line driving circuit 6 outputs, for each raw of pixels 2 which are arranged in the X-axis direction (in a raw direction) of the display portion 3, a selection signal for selecting the pixels 2 which compose the each raw and which are designated by the controller 9. When outputting the selection signals, as shown in FIG. 2, the scanning line driving circuit 6 sequentially outputs each of the selection signals onto a corresponding one of the plurality of scanning lines 4 (Y1, Y2, . . . , and Ym) which are wired along the X-axis direction of the display portion 3.

Figure 2:
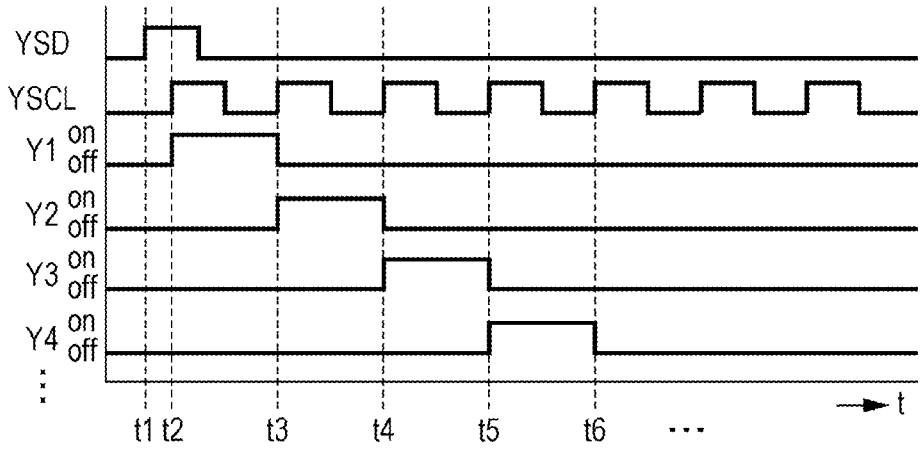
FIG. 2 is a timing diagram illustrating an example of operation of a scanning line driving circuit according to an embodiment of the invention.

FIG. 2 is a timing diagram illustrating an example of operation of the scanning line driving circuit 6.

The scanning line driving circuit 6 is constituted by a shift register. The scanning line driving circuit 6 reads in a scanning start signal YSD at a rising edge of a shift clock signal YSCL, and subsequently, sequentially performs shift operation at each rising edge of the shift clock signal YSCL. The scanning line driving circuit 6 sequentially outputs a result of the shift operation, as a selection signal, to the pixels 2 composing each row through a corresponding one of the scanning lines 4 (Y1, Y2, . . . , and Ym). The selection signal has two electric potential levels, and in the following description, a higher electric potential level thereof and a lower electric potential level thereof will be denoted by "H" and "L", respectively.

In addition, in this embodiment, it is supposed that, when a pixel 2 is selected, an electric potential level of a scanning line 4 connected to the pixel 2 is made "H", and when the pixel 2 is not selected, an electric potential of level of the scanning line 4 connected to the pixel 2 is made "L".

Further, in this example, it has been described that the scanning line driving circuit 6 reads in the scanning start signal YSD at a rising edge of the shift clock signal YSCL, but the invention is not limited to this configuration. The scanning line driving circuit 6 may read in the scanning start signal YSD at a falling edge of the shift clock signal YSCL, and subsequently may perform shift operation at each falling edge of the shift clock signal YSCL or at each of rising and falling edges of the shift clock signal YSCL.

Figure 3:
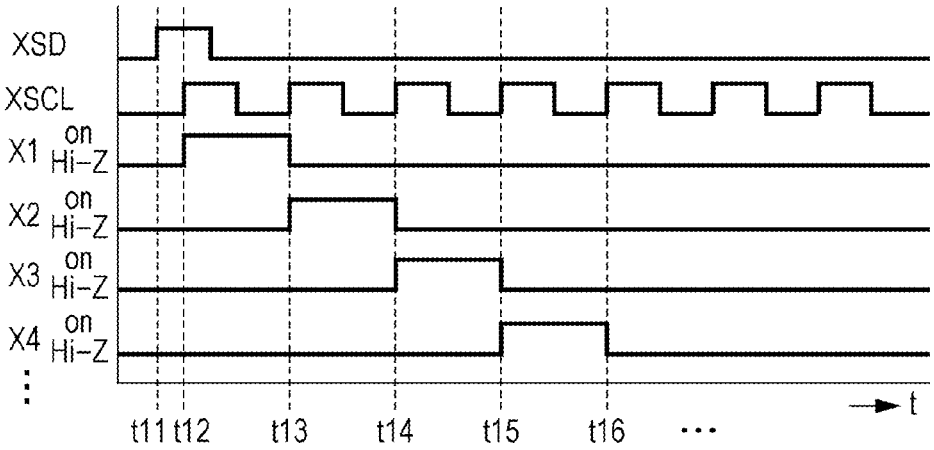
FIG. 3 is a timing diagram illustrating an example of operation of a data line driving circuit according to an embodiment of the invention.

The data line driving circuit 7 outputs, as shown in FIG. 3, for each column of pixels 2 which are arranged in the Y-axis direction (in a column direction) of the display portion 3, a piece of image data having been input from the controller 9 to a corresponding one of the plurality of data lines 5 (X1, X2, . . . , and Xn) which are wired along the Y-axis direction of the display portion 3.

FIG. 3 is a timing diagram illustrating an example of operation of the data line driving circuit 7.

All signals input/output to/from the data line driving circuit 7 each have two electric potential levels, and in the following description, a higher electric potential level thereof and a lower electric potential level thereof will be denoted by "H" and "L", respectively. The data line driving circuit 7 is constituted by a shift register. The data line driving circuit 7 reads in a scanning start signal XSD at a rising edge of a shift clock signal XSCL, and subsequently, sequentially performs shift operation at each rising edge of the shift clock signal XSCL. The data line driving circuit 7 performs shift operation so as to cause a register outputting "H" to be shifted one by one inside a shift register circuit, and thereby sequentially selects a data line which constitutes the data lines 5 (X1, X2, . . . , and Xn), and which corresponds to the output "H". Through a data line 5 having been selected, an electric potential of a piece of image data transmitted from the controller 9 is output to a corresponding pixel 2 in synchronization with the selection. In contrast, non-selected data lines 5, each associated with a corresponding one of registers outputting "L", become a high impedance state (Hi-Z).

In addition, in this embodiment, an electric potential of the piece of image data has two electric potential levels, and in the following description, a higher electric potential level thereof and a lower electric potential level thereof will be denoted by "H" and "L", respectively.

Further, in this example, it has been described that the data line driving circuit 7 reads in the scanning start signal XSD at a rising edge of the shift clock signal XSCL, but the invention is not limited to this configuration. The data line driving circuit 7 may read in the scanning start signal XSD at a falling edge of the shift clock signal XSCL, and subsequently may perform shift operation at each falling edge of the shift clock signal XSCL or at each of rising and falling edges of the shift clock signal XSCL.

The common electric source modulating circuit 8 supplies, in accordance with control of the controller 9, each of a common electrode electric source line 12, a pixel control line 13, a pixel control line 14, and a pixel control line 15, these lines being used common to all the pixels 2, with a corresponding one of electric potentials necessary to drive each of the pixels 2. In each pixel 2, individual electrophoretic particles inside the each pixel 2 are electrophoresed in accordance with an electric potential of a piece of image data having been written into the each pixel 2, as well as electric potentials each supplied from the common electric source modulating circuit 8 through a corresponding one of the common electrode electric source line 12, the pixel control line 13, the pixel control line 14, and the pixel control line 15, and as a result, an image is displayed on the electrophoretic apparatus 1.

An electric potential VEP0 supplied to the pixel control line 13 from the common electric source modulating circuit 8 is switched in accordance with control of the controller 9 in order to change display of each pixel 2 in accordance with an electric potential of a piece of image data having been written into the each pixel 2. Further, an electric potential VEP1 supplied to the pixel control line 14 from the common electric source modulating circuit 8, as well as an electric potential VEP2 supplied to the pixel control line 15 from the common electric source modulating circuit 8, is also switched in accordance with control of the controller 9.

An electric potential VCOM supplied to the common electrode electric source line 12 from the common electric source modulating circuit 8 is controlled by the controller 9.

The controller 9 controls operation of each of the scanning line driving circuit 6, the data line driving circuit 7, and the common electric source modulating circuit 8 on the basis of control signals input from a control unit (not illustrated) which is included in the electrophoretic apparatus 1, and which is constituted by components, such as a central processing unit (CPU).

Next, a configuration of each pixel circuit in the electrophoretic apparatus 1 according to this embodiment will be described.

Figure 4:
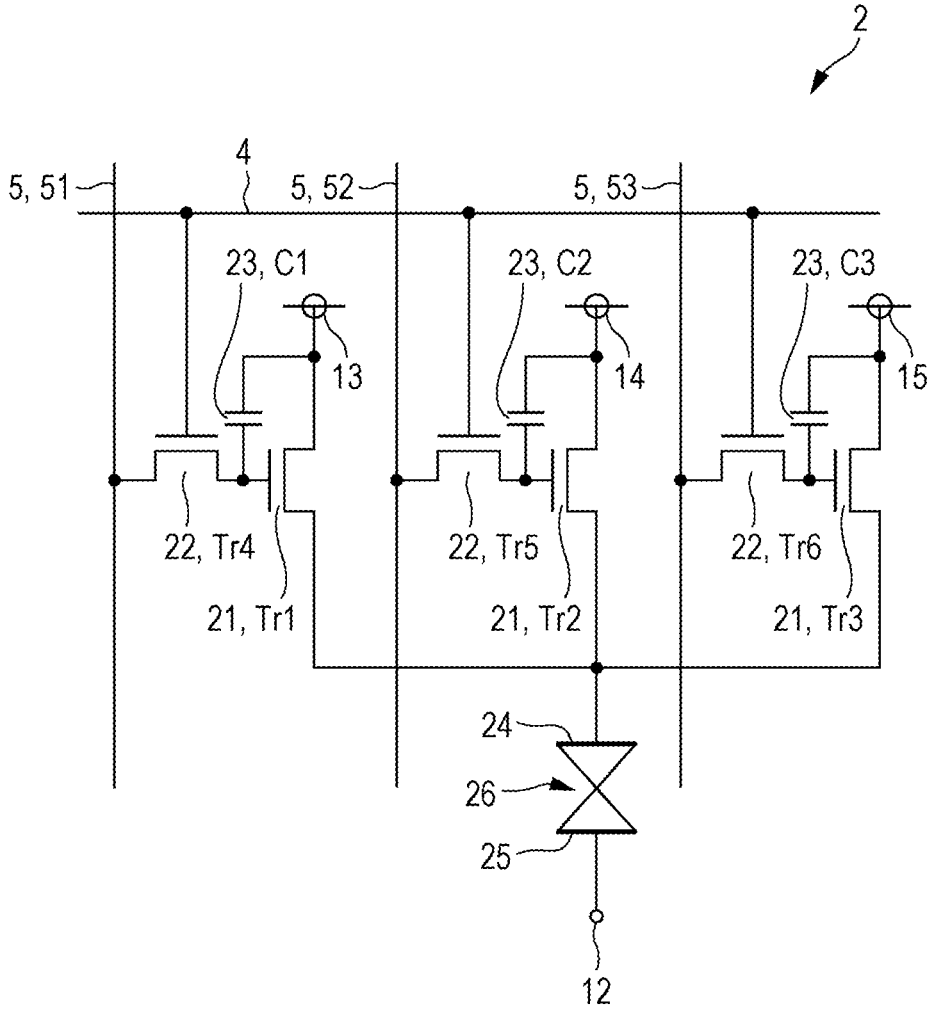
FIG. 4 is a block diagram illustrating an example of a configuration of a circuit configuration of a pixel of an electrophoretic apparatus according to an embodiment of the invention.

FIG. 4 is a block diagram illustrating an example of a circuit configuration of each pixel 2 in the electrophoretic apparatus 1 according to this embodiment. As shown in FIG. 4, each pixel 2 includes driving transistors 21, selection transistors 22, capacitors 23, a pixel electrode 24, a common electrode 25, and an electrophoretic element 26. Among these components, the driving transistors 21 include transistors Tr1, Tr2, and Tr3. Further, the selection transistors 22 include transistors Tr4, Tr5, and Tr6. Further, the capacitors 23 include capacitors C1, C2, and C3.

Further, one of the scanning lines 4, one of the data lines 5, the common electrode electric source line 12, the pixel control line 13, the pixel control line 14, and the pixel control line 15 are connected to each pixel 2. Among these lines, the one of the data lines 5 includes data lines 51, 52, and 53.

As shown in the configuration in FIG. 4, each pixel 2 has a pixel structure in which six transistors and three capacitors are provided.

In addition, in the following description, each of the capacitors 23 will be described as a capacitor element (a component) which is provided independently from a corresponding one of the driving transistors 21, but the invention is not limited to this configuration. Each of the capacitors 23 is sufficient if it has capacitance enough to keep ON state (or OFF state) of a corresponding one of the driving transistors 21 while a corresponding one of the selection transistors 22 is in OFF state. For example, each of the capacitors 23 may be parasitic capacitance of a corresponding one of the driving transistors 21.

Each of the driving transistors 21 is a switching element for selecting a voltage applied to the pixel electrode 24, and is formed of, for example, an N-type metal oxide semiconductor (MOS). A gate terminal of each of the driving transistors 21 is connected to a drain terminal of a corresponding one of the selection transistors 22 and one of electrodes of a corresponding one of the capacitors 23. Further, a source terminal of each of the driving transistors 21 is connected to the other one of the electrodes of a corresponding one of the capacitors 23 and any one of the pixel control line 13, the pixel control line 14, and the pixel control line 15. In addition, the other one of the electrodes of each of the capacitors 23 may not be connected to the source terminal of a corresponding one of the driving transistors 21, but may be connected to a corresponding one of optionally provided electric potential lines. More specifically, a source terminal of the transistor Tr1 of the driving transistors 21 is connected to the capacitor C1 and the pixel control line 13. Further, a source terminal of the transistor Tr2 is connected to the capacitor C2 and the pixel control line 14. Further, a source terminal of the transistor Tr3 is connected to the capacitor C3 and the pixel control line 15. Further, a drain terminal of each of the driving transistors 21 (i.e., the transistors Tr1, Tr2, and Tr3) is connected to the pixel electrode 24.

Each of the selection transistors 22 is a pixel switching element for selecting one of the pixels 2, and is formed of, for example, an N-type metal oxide semiconductor (MOS). A gate terminal of each of the selection transistors 22 (i.e., the transistors Tr4, Tr5, and Tr6) is connected to one of the scanning lines 4; a source terminal of the each selection transistor 22 is connected to one of the data lines 5; and a drain terminal of the each selection transistor 22 is connected to a gate terminal of a corresponding one of the driving transistors 21. Each of the selection transistors 22 causes a piece of image data, which is input from the data line driving circuit 7 via the one of the data lines 5, to enter a corresponding one of the driving transistors 21 by connecting the one of the data lines 5 to the corresponding one of the driving transistors 21 during a period when a selection signal is input from the scanning driving circuit 6 via the one of the scanning lines 4.

Next, an electric potential supplied to the pixel electrode 24 by the controller 9 will be specifically described. As described above, the controller 9 supplies the electric potential VEP0 TO the pixel electrode 24 from the pixel control line 13 via one of the driving transistors 21 (i.e., the transistor Tr1). Further, the controller 9 supplies the pixel electrode 24 with the electric potential VEP1 from the pixel control line 14 via one of the driving transistors 21 (i.e., the transistor Tr2). Further, the controller 9 supplies the pixel electrode 24 with the electric potential VEP2 from the pixel control line 15 via one of the driving transistors 21 (i.e., the transistor Tr3).

Here, the common electric source modulating circuit 8 performs change control of electric potential levels each of a corresponding one of the electric potential VCOM, the electric potential VEP0, the electric potential VEP1, and the electric potential VEP2 in accordance with directions from the controller 9. Specifically, during a program period and during a retention period, the control is performed such that electric potential levels each of a corresponding one of the electric potential VCOM, the electric potential VEP0, the electric potential VEP1, and the electric potential VEP2 are made equal to an identical electric potential level. Further, during an electrophoretic migration period, the control is performed such that an electric potential level of the electric potential VEP1 is made equal to that of the electric potential VCOM; an electric potential level of the electric potential VEP1 is made equal to, for example, an electric potential level lower than that of the electric potential VCOM: and an electric potential level of the electric potential VEP2 is made equal to an electric potential level higher than that of the electric potential VCOM. In addition, hereinafter, description will be made supposing that an electric potential which is supplied to the electric potential VEP1 and which has an electric potential level lower than that of the electric potential VCOM is an electric potential which causes each pixel 2 to display a black color (this electric potential will be referred to as, for example, an electric potential Vb), and an electric potential which is supplied to the electric potential VEP2 and which has an electric potential level higher than that of the electric potential VCOM is an electric potential which causes each pixel 2 to display a white color (this electric potential will be referred to as, for example, an electric potential Vw). Operation of this circuit will be described below.

The electrophoretic element 26 is interposed between the pixel electrode 24 and the common electrode 25, and is provided with a plurality of microcapsules each containing charged white particles and charged black particles. Further, in accordance with an electric potential difference between the pixel electrode 24 and the common electrode 25, the charged white particles and the charged black particles are electrophoresed. As a result, an image is displayed, which has a grayscale level in accordance with distances by which the individual white particles have been electrophoresed and distances by which the individual black particles have been electrophoresed.

Through control of directions and movement amounts of the individual electrophoresed white particles and directions and movement amounts of the individual electrophoresed black particles, a grayscale level of an image displayed by each pixel 2 can be controlled.

Next, the display portion 3 of the electrophoretic apparatus 1 according to this embodiment will be described.

Figure 5A:
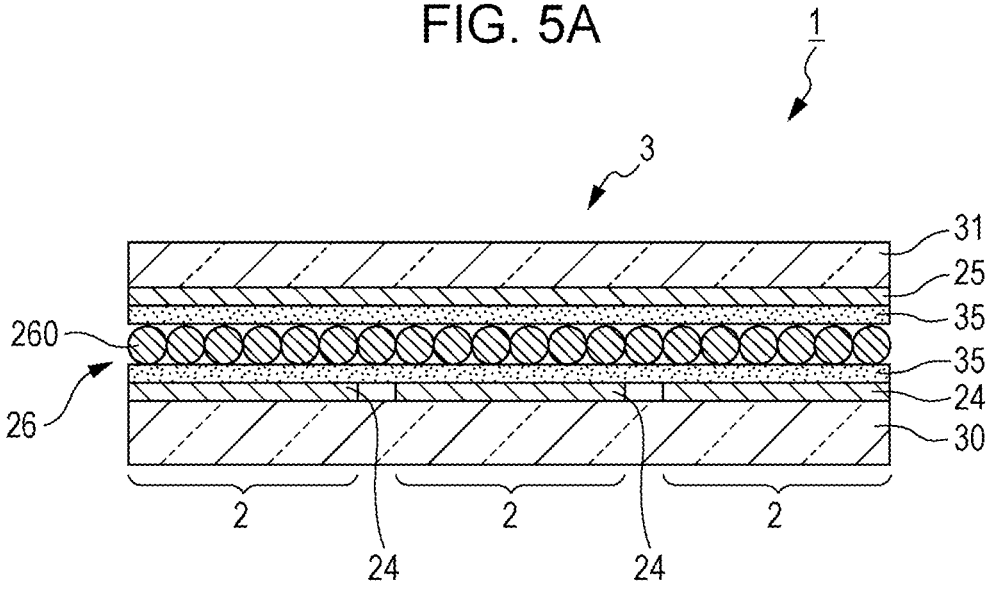
FIGS. 5A and 5B are schematic diagrams illustrating an example of a configuration of a display portion according to an embodiment of the invention.
Figure 5B:
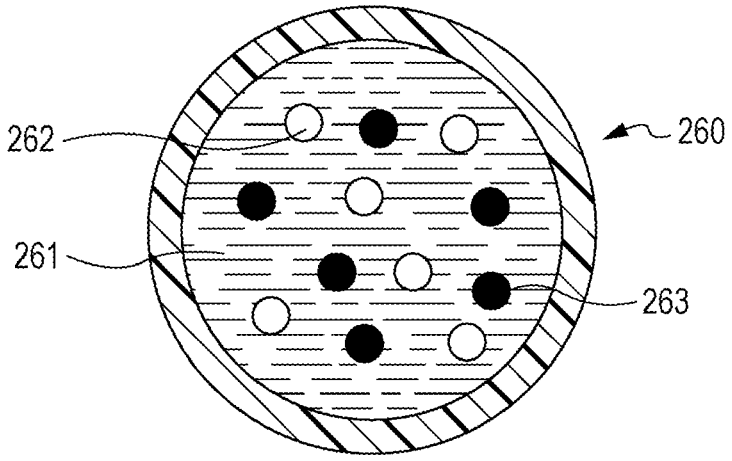

FIGS. 5A and 5B are schematic diagrams illustrating an example of a configuration of the display portion 3 of the electrophoretic apparatus 1 according to this embodiment. FIG. 5A illustrates a partial cross-sectional view of the display portion 3. Further, FIG. 5B illustrates a configuration of a microcapsule.

As shown in FIG. 5A, the display portion 3 is configured such that the electrophoretic element 26 is interposed between an element substrate 30 provided with the pixel electrodes 24 and an opposing substrate 31 provided with the common electrode 25. The electrophoretic element 26 is constituted by a plurality of microcapsules 260. The electrophoretic element 26 is fixed between the element substrate 30 and the opposing substrate 31 by using adhesive agent layers 35. That is, each of the adhesive agent layers 35 is formed at a corresponding one of two positions, one being a position between the electrophoretic element 26 and the element substrate 30, the other one being a position between the electrophoretic element 26 and the opposing substrate 31.

In addition, the adhesive agent layer 35 at the element substrate 30 side is necessary to bond the electrophoretic element 26 to a face of each of the pixel electrodes 24, but the adhesive agent layer 35 at the opposing substrate 31 side is not necessary. This is because, in the case where, after coherent manufacturing processes in which the common electrode 25, the plurality of microcapsules 260, and the adhesive agent layer 35 of the opposing substrate 31 have been produced onto the opposing substrate 31 in advance, a resultant product is handled as an electrophoretic sheet, it is supposed a case where the adhesive agent layer required to be provided results in only the adhesive agent layer 35 of the element substrate 30 side.

The element substrate 30 is a substrate made of, for example, a glass material or a plastic material. On the element substrate 30, the pixel electrode 24 is disposed for each of the pixels 2 so as to be formed in a rectangular shape. Although omitted from illustration, in an area among the individual pixel electrodes 24 and on a lower face of each of the pixel electrodes 24 (on an element substrate 30 side face of each of the pixel electrodes 24 in FIG. 5A), there are formed the scanning lines 4, the data lines 5, the common electrode electric source line 12, the pixel control line 13, the pixel control line 14, the pixel control line 15, the driving transistors 21, the selection transistors 22, the capacitors 23, and the like, which are shown in FIG. 1, FIG. 4 and the like.

The opposing substrate 31 is a substrate made of a material having translucency, such as glass, because it is provided at a side where an image is displayed. The common electrode 25 formed on the opposing substrate 31 is made of a material having translucency and electrical conductivity, such as magnesium silver (MgAg), indium tin oxide (ITO), or indium tin oxide (IZO (trademark)).

In addition, it is common that the electrophoretic element 26 is formed at the opposing substrate 31 side in advance, and is handled as an electrophoretic sheet including portions up to the adhesive agent layer 35 at the element substrate 30 side. Further, release paper for protection is bonded onto a face at the element substrate 30 side of the adhesive agent layer 35.

In a manufacturing process, the display portion 3 is formed by bonding the electrophoretic sheet, from which the release paper has been removed, onto the element substrate 30 which has been produced in a different manufacturing process and on which the pixel electrode 24, the circuits, and the like have been formed. For this reason, in a general configuration, the adhesive agent layer 35 exists only at the pixel electrode 24 side.

FIG. 5B is a diagram illustrating a configuration of the microcapsule 260. The microcapsule 260 has a particle diameter of, for example, around 50 μm. The outer shell portion of the microcapsule 260 is formed by using polymeric resin having translucency, such as acrylate resin (for example, polymethyl methacrylate or polyethyl methacrylate), urea resin or gum arabic. The microcapsules 260 are interposed between the common electrode 25 and the pixel electrodes 24, and at least one of the microcapsules 260 is vertically and horizontally arrayed within one pixel. There is provided a binder (omitted from illustration) for fixing the microcapsules 260 so as to infill portions surrounding the individual microcapsules 260.

Further, in the inside of each of the microcapsules 260, a dispersion medium 261 and charged particles operating as electrophoretic particles, that is, the plurality of white particles 262 and the plurality of black particles 263, are encapsulated.

The dispersion medium 261 is liquid for dispersing the white particles 262 and the black particles 263 inside the microcapsule 260.

The dispersion medium 261 can be obtained by using a solvent resulting from mixing a surface-active agent with a single one or a mixed one of substances as follows: water; alcohols solvents, such as methanol, ethanol, isopropanol, butanol, octanol, and methyl cellosolve; various esters, such as ethyl acetate and butyl acetate; ketones, such as acetone, methyl ethyl ketone, and methyl isobutyl ketone; aliphatic hydrocarbons, such as pentane, hexane, and octane; alicyclic hydrocarbons, such as cyclohexane and methyl cyclohexane; aromatic hydrocarbons including benzenes each having a long-chain alkyl base; such as benzene, toluene, xylene, hexylbenzene, heptylbenzene, octylbenzene, nonylbenzene, decylbenzene, undecylbenzene, dodecylbenzene, tridecylbenzene, and tetradecylbenzene; methylene chloride; chloroform; carbon tetrachloride; halogenated hydrocarbons, such as 1,2-dichloroethane; carboxylate; and other various oils.

The white particles 262 are particles (polymer molecules or colloids) each made of a white pigment, such as titanium dioxide, zinc oxide, or antimony trioxide, and are charged to, for example, negative (−) electric potential.

The black particles 263 are particles (polymer molecules or colloids) each made of a black pigment, such as aniline black or carbon black, and are charged to, for example, positive (+) electric potential.

Thus, in the inside of the dispersion medium 261, the white particles 262 and the black particles 263 can move in an electric field caused by an electric potential difference between the pixel electrode 24 and the common electrode 25.

Further, when needed, any one or ones of a charge control agent composed of particles of an electrolyte, a surface-active agent, a metallic soap, a resin, a rubber, oil, a varnish, a compound, or the like, a dispersion agent, such as a titanium coupling agent, an aluminum coupling agent, or a silane coupling agent, a lubricant agent, a stabilizing agent, and the like, can be added to each of the above pigments.

Next, operation of the electrophoretic element 26 of the electrophoretic 1 according to this embodiment will be described with reference to FIGS. 6A, 6B, and 7.

Figure 6A:
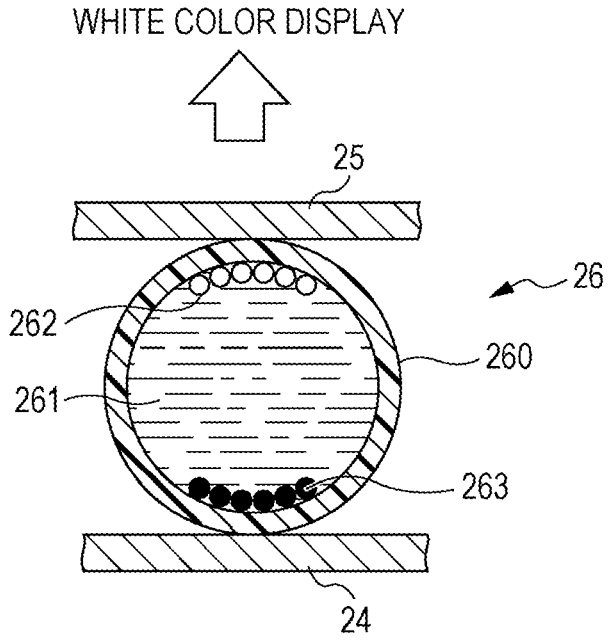
FIGS. 6A and 6B are schematic diagrams illustrating an example of operation of an electrophoretic element according to an embodiment of the invention.
Figure 6B:
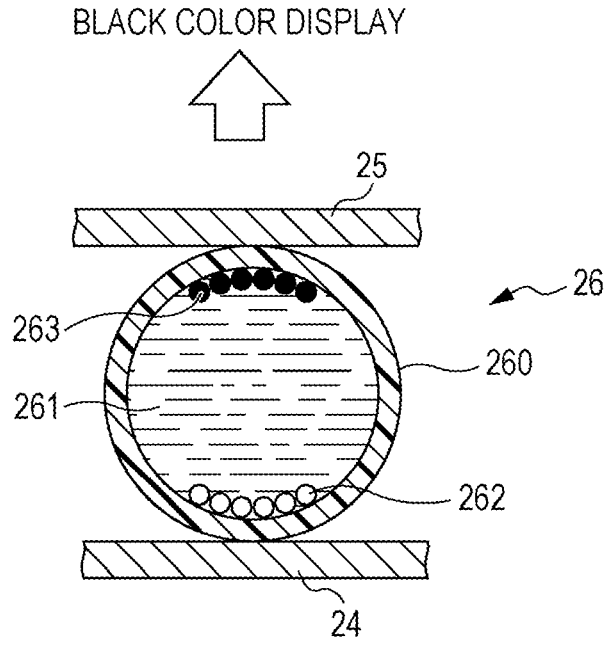

FIGS. 6A and 6B are schematic diagrams illustrating an example of operation of the electrophoretic element 26 of the electrophoretic apparatus 1 according to this embodiment. Further, FIG. 6A and FIG. 6B illustrate a case where the pixel 2 displays a white color and a case where the pixel 2 displays a black color, respectively.

Figure 7:
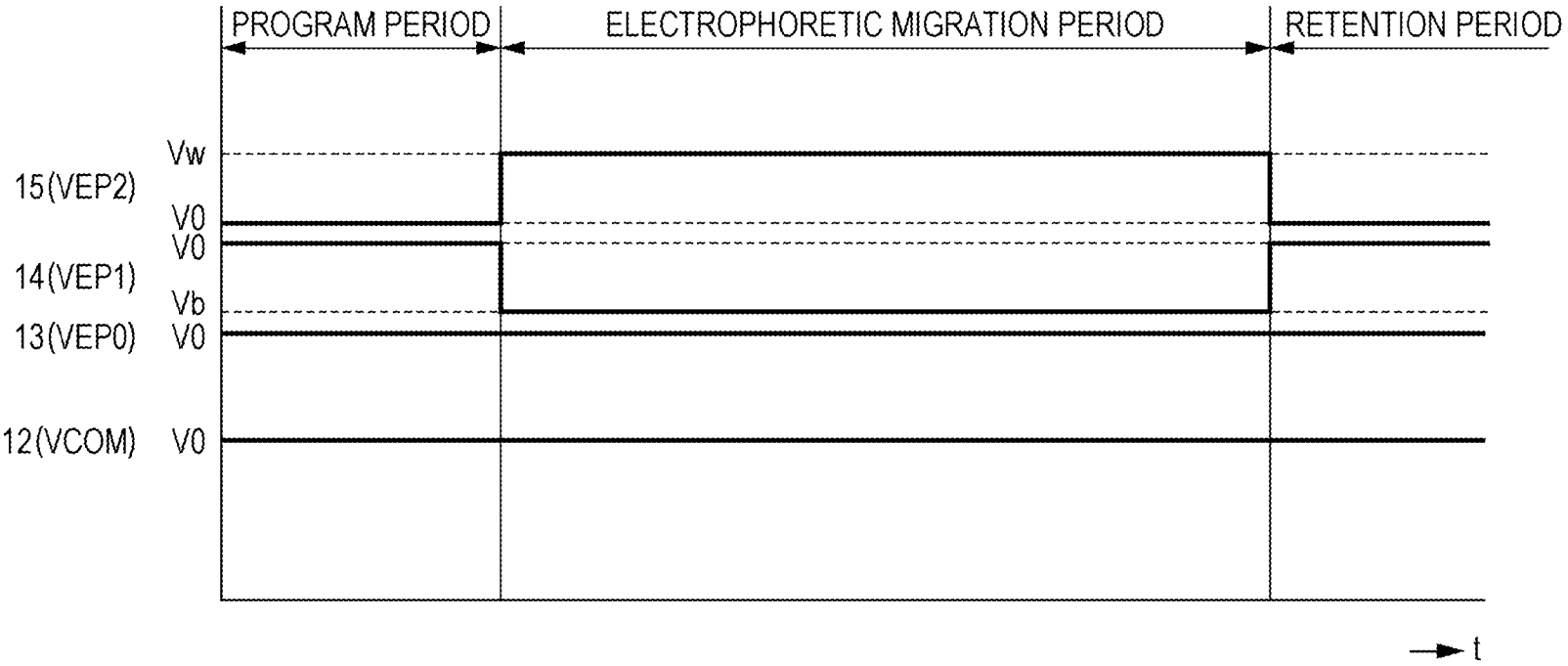
FIG. 7 is a timing diagram illustrating an example of operation of an electrophoretic element according to an embodiment of the invention.

FIG. 7 is a timing diagram illustrating an example of operation of the electrophoretic element 26 of the electrophoretic apparatus 1 according to this embodiment.

In addition, in the following description, it is supposed that the white particles 262 are charged to positive (+) electric potential, and the black particles 263 are charged to negative (−) electric potential.

First, a case where a display state of a certain pixel 2 is caused to be changed from a black color display state to a white color display state shown in FIG. 6A will be described. When a display state of the pixel 2 is made a white color display state, the electric potential VCOM is applied to the common electrode 25 and the electric potential VEP2 is applied to the pixel electrode 24. As described above, since this, during the electrophoretic migration period, electric potential VEP2 is made an electric potential (for example, the electric potential Vw) which causes the pixel 2 to display the white color, an electric potential difference arises between the pixel electrode 24 and the common electrode 25. Further, this electric potential difference causes the white particles 262 to be electrophoresed toward the common electrode 25 side, and causes the black particles 263 to be electrophoresed toward the pixel electrode 24 side. As a result, the pixel 2 enters the white color (W) display state (white color display).

Further, a case where a display state of the pixel 2 is caused to be changed from a white color display state to a black color display state shown in FIG. 6B will be described. When a display state of the pixel 2 is made a black color display state, the electric potential VCOM is applied to the common electrode 25 and the electric potential VEP1 is applied to the pixel electrode 24. As described above, since, during the electrophoretic migration period, this electric potential VEP1 is made an electric potential (for example, the electric potential Vb) which causes the pixel 2 to display the black color, an electric potential difference arises between the pixel electrode 24 and the common electrode 25. Further, this electric potential difference causes the black particles 263 to be electrophoresed toward the common electrode 25 side, and causes the white particles 262 to be electrophoresed toward the pixel electrode 24 side. As a result, the pixel 2 enters the black color (B) display state (black color display).

Further, a case where a display state of the pixel 2 is retained, that is, a case where a white display state is retained as it is or a case where a black display state is retained as it is, will be described. When a display state of the pixel 2 is caused to be retained, the electric potential VCOM is applied to the common electrode 25 and the electric potential VEP0 is applied to the pixel electrode 24. As described above, an electric potential level of this electric potential VEP0 is also equal to that of the electric potential VCOM during the electrophoretic migration period. As a result, since any electric potential difference does not arise between the pixel electrode 24 and the common electrode 25, the black particles 263 as well as the white particles are not electrophoresed, and a display state of the pixel 2 is retained.

Here, the aforementioned control of the display states of the pixel 2 will be described more specifically. When a display state of a certain pixel 2 is caused to be changed from a black display state to a white display state, the electric potential VEP2 is supplied to the pixel electrode 24 of the pixel 2 during the program period shown in FIG. 7. Specifically, for the transistors Tr1, Tr2, and Tr3 among the driving transistors 21, each of the transistors Tr1 and Tr2 is made OFF state and the transistor Tr3 is made ON state. More specifically, in the state where each of the data lines 51 and 52 is made "L" and the data line 53 is made "H", the scanning line 4 for selecting the pixel 2 is made "H". Through this operation, each of the transistors Tr4, Tr5, and Tr6 enters ON state. Further, through this operation, for the transistors Tr1, Tr2, and Tr3 among the driving transistors 21 of the pixel 2, each of the transistors Tr1 and Tr2 enters OFF state and the transistor Tr3 enters ON state. That is, the pixel control line 15 for supplying the electric potential VEP2 and the pixel electrode 24 of the pixel 2 enter a state of being connected to each other via the transistor Tr3.

Next, the scanning line 4 in the state of selecting the pixel 2 is made "L". Through this operation, each of the selection transistors 22 of the pixel 2 enters OFF state. At this time, an electric potential of the gate terminal of each of the driving transistors 21 of the pixel 2 is retained by a corresponding one of the capacitors 23. Thus, each of the driving transistors 21 is retained to ON state or OFF state, whichever is a state when a corresponding one of the selection transistors 22 has been in ON state. Specifically, when the transistor Tr4 has entered OFF state, an electric potential level of the gate terminal of the transistor Tr1 is retained to "L" by the capacitor C1. Through this operation, the transistor Tr1 is retained to OFF state. Each of the transistors Tr2 and Tr3 also operates in the same manner as that of the transistor Tr1. That is, when the transistor Tr5 has entered OFF state, an electric potential level of the gate terminal of the transistor Tr2 is retained to "L" by the capacitor C2. Through this operation, the transistor Tr2 is retained to OFF state. Further, when the transistor Tr6 has entered OFF state, an electric potential level of the gate terminal of the transistor Tr3 is retained to "H" by the capacitor C3. Through this operation, the transistor Tr3 is retained to ON state.

Further, as shown in FIG. 6B, when a display state of a certain pixel 2 is caused to be changed from the white display state to the black display state, the electric potential VEP1 is supplied to the pixel electrode 24 of the pixel 2 during the program period shown in FIG. 7. Specifically, for the transistors 4, 5, and 6 among the selection transistors 22, the transistors Tr4 and Tr6 are made OFF state and the transistor Tr5 is made ON state. More specifically, in the state where each of the data lines 51 and 53 is made "L" and the data line 52 is made "H", the controller 9 makes the scanning line 4 for selecting the pixel 2 "H". Through this operation, the transistors Tr4 and Tr6 enter OFF state and the transistor Tr5 enters ON state. Thus, for the transistors Tr1, Tr2, and Tr3 among the driving transistors 21 of the pixel 2, the transistors Tr1 and Tr3 enter OFF state and the transistor Tr2 enters ON state. That is, the pixel control line 14 for supplying the electric potential VEP1 and the pixel electrode 24 of the pixel 2 enter a state of being connected to each other via the transistor Tr2.

Next, the scanning line 4 in the state of selecting the pixel 2 is made "L". Through this operation, each of the selection transistors 22 of the pixel 2 enters OFF state. At this time, an electric potential of the gate terminal of each of the driving transistors 21 of the pixel 2 is retained by a corresponding one of the capacitors 23. A mechanism in which an electric potential of the gate terminal of each of the driving transistors 21 of the pixel 2 is retained by a corresponding one of the capacitors 23 is the same as that of the above-described case where a display state of the pixel 2 is caused to be changed from the black color display state to the white color display state, and thus, description of the mechanism is omitted here.

Further, when a display state of a certain pixel 2 is caused not to be changed, during the program state shown in FIG. 7, for the transistors Tr4, Tr5, and Tr6 among the selection transistors 22, each of the transistors Tr5 and Tr6 is made OFF state and the transistor Tr4 is made ON state. Specifically, in the state where each of the data lines 52 and 53 is made "L" and the data line 51 is made "H", the scanning line 4 for selecting the pixel 2 is made "H". Through this operation, for the pixel 2, each of the transistors Tr5 and Tr6 enters OFF state and the transistor 4 enters ON state. Thus, for the transistors Tr1, Tr2, and Tr3 among the driving transistors 21, each of the transistors Tr2 and Tr3 enters OFF state and the transistor Tr1 enters ON state. That is, the pixel control line 13 for supplying the electric potential VEP0 and the pixel electrode 24 of the pixel 2 enter a state of being connected to each other via the transistor Tr1.

Next, the scanning line 4 in the state of selecting the pixel 2 is made "L". Through this operation, each of the selection transistors 22 of the pixel 2 enters OFF state. At this time, an electric potential of the gate terminal of each of the driving transistors 21 of the pixel 2 is retained by a corresponding one of the capacitors 23. A mechanism in which an electric potential of the gate terminal of each of the driving transistors 21 of the pixel 2 is retained by a corresponding one of the capacitors 23 is the same as that of the above-described case where a display state of the pixel 2 is caused to be changed from the black color display state to the white color display state, and thus, description of the mechanism is omitted here.

During the program period, the controller 9 performs control (programing) of states of the driving transistors 21 of each pixel 2 by performing the above-described operation on the each pixel 2.

Next, during the electrophoretic migration period shown in FIG. 7, the electric potential VEP0 is supplied to the pixel control line 13; the electric potential VEP1 is supplied to the pixel control line 14; and the electric potential VEP2 is supplied to the pixel control line 15. At this moment, the pixel electrode 24 is supplied with the electric potential VEP0, the electric potential VEP1, or the electric potential VEP2, whichever is supplied to one of the pixel control lines which is connected to one of the driving transistors which is ON state.

In this specific example, when the electric potential VEP0 is supplied to the pixel electrode 24 by causing the transistor Tr1 to enter ON state, any electric potential difference does not arise between the pixel electrode 24 and the common electrode 25. Thus, the black particles 263 as well as the white particles 262 are not electrophoresed and, as a result, a display state of the pixel 2 is retained.

Further, when the electric potential VEP1 is supplied to the pixel electrode 24 by causing the transistor Tr2 to enter ON state, an electric potential difference arises between the pixel electrode 24 and the common electrode 25. Further, this electric potential difference causes the black particles 263 to be electrophoresed toward the common electrode 25 side, and causes the white particles 262 to be electrophoresed toward the pixel electrode 24 side. As a result, the pixel 2 enters the black color (B) display state (black color display).

Further, when the electric potential VEP2 is supplied to the pixel electrode 24 by causing the transistor Tr3 to enter ON state, an electric potential difference arises between the pixel electrode 24 and the common electrode 25. Further, this electric potential difference causes the white particles 262 to be electrophoresed toward the common electrode 25 side, and causes the black particles 263 to be electrophoresed toward the pixel electrode 24 side. As a result, the pixel 2 enters the white color (W) display state (white color display).

Next, during the retention period shown in FIG. 7, the electric potential VEP0 is supplied to the pixel electrode 24 of the pixel 2. Operation of the pixel 2 is the same as that of the case where a display state of the pixel 2 is retained during the program period, and thus, detailed description of the operation of the pixel 2 is omitted here. As a result, since any electric potential difference does not arise between the pixel electrode 24 and the common electrode 25, the black particles 263 as well as the white particles 262 are not electrophoresed and a display state of the pixel 2 is retained.

As described above, for the electrophoretic element 26, the electrophoresis of the white particles and that of the black particles can be controlled by using the electric potential VCOM which is supplied via the common electrode electric source line 12 and which is input to the common electrode 25 as well the electric potential VEP0 supplied via the pixel control line 13, the electric potential VEP1 supplied via the pixel control line 14, or the electric potential VEP2 supplied via the pixel control line 15, whichever is selected on the basis of a piece of image data written into the pixel 2 and is input to the pixel electrode 24.

As described above, the electrophoretic apparatus 1 makes it possible for each pixel 2 (each electrophoretic element 26) to retain an electric potential having been supplied to the each pixel 2 when the each pixel 2 has been selected by the scanning line 4 even in the state in which the each pixel 2 is not selected by the scanning line 4. Through this configuration, an electric potential of each pixel 2 becomes stable, and thus, the electrophoretic apparatus 1 makes it possible to reduce a degree of a variation of an electric potential of each pixel 2, which is caused by an electric potential of a pixel adjacent to the each pixel 2. Thus, the electrophoretic apparatus 1 makes it possible to reduce a degree of blurring in display of each pixel 2 due to a variation of each of electric potentials of the each pixel 2, which is caused by electric potentials of a pixel 2 adjacent to the each pixel 2.

MODIFICATION EXAMPLE

Figure 8:
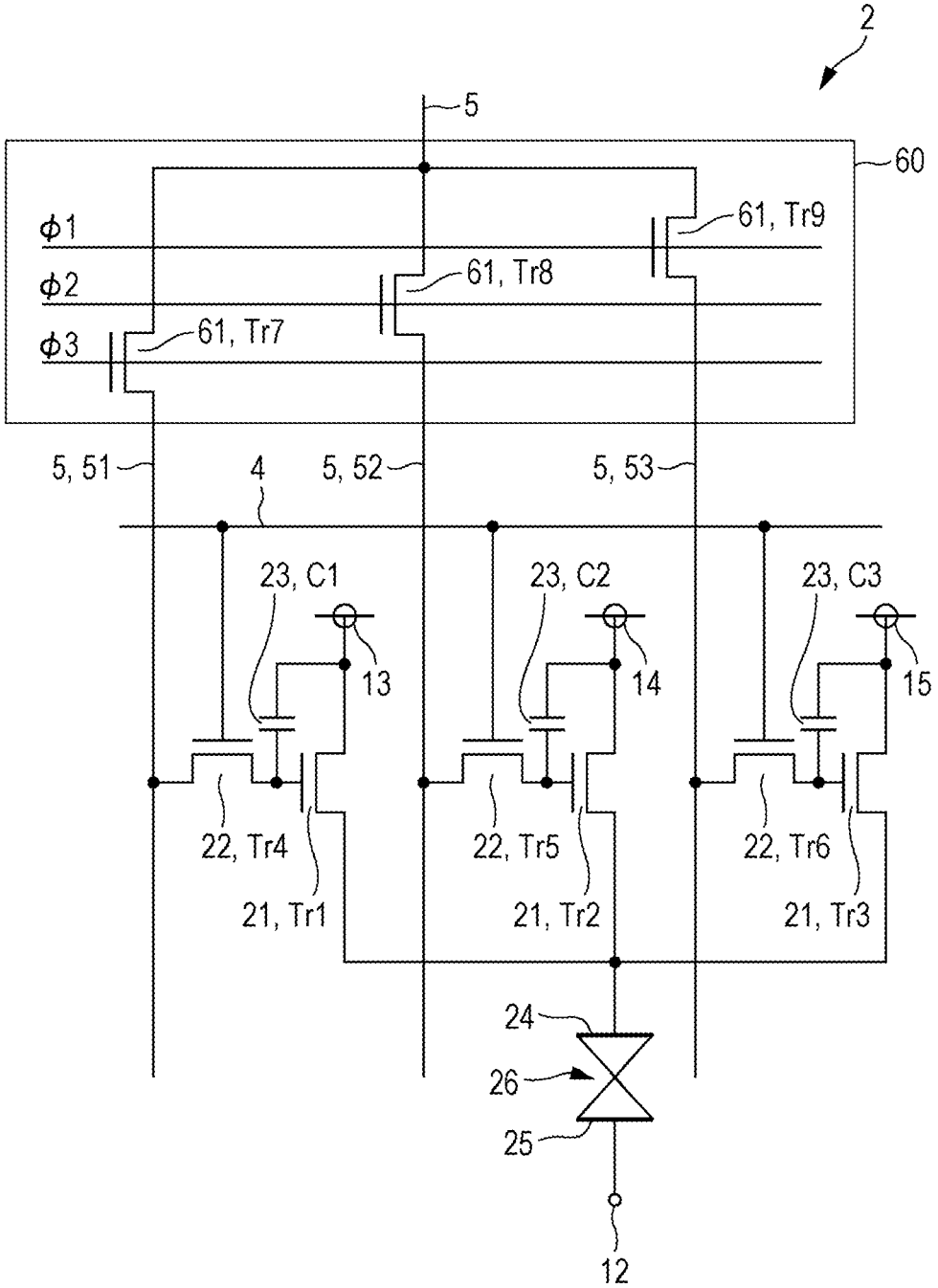
FIG. 8 is a block diagram illustrating a first modification example of a circuit configuration of a pixel according to an embodiment of the invention.

The electrophoretic apparatus 1 according to this embodiment can be also configured in a manner shown in FIG. 8.

FIG. 8 is a block diagram illustrating a first modification example of the circuit configuration of the pixel 2. In this modification example, the pixel 2 includes a source demultiplexing circuit 60. This source demultiplexing circuit 60 generates signals each associated with a corresponding one of the data lines 51, 52, and 53 by demultiplexing the signals which are time-division multiplexed on the data line 5. Specifically, the source demultiplexing circuit 60 includes demultiplexing transistors 61. The demultiplexing transistors 61 include transistors Tr7, Tr8, and Tr9. The transistor Tr7 has ON and OFF states which are switched to each other in accordance with an electric potential of a control line φ1 which is connected to the controller 9. Further, the transistor Tr8 has ON and OFF states which are switched to each other in accordance with an electric potential of a control line φ2 which is connected to the controller 9. Further, the transistor Tr9 has ON and OFF states which are switched to each other in accordance with an electric potential of a control line φ3 which is connected to the controller 9. The controller 9 generates signals each associated with a corresponding one of the data line 51, the data line 52, and the data line 53 by demultiplexing the signals which are time-division multiplexed on the data line 5, that is, by sequentially causing each of the demultiplexing transistors 61 to perform operation of switching between ON and OFF states. Here, parasitic capacitance exists on each of the data lines 51, 52, and 53. During a period from a time point when each of signals which is associated with a corresponding one of the data lines 51, 52, and 53 is generated until a time point when the pixel 2 is selected by the scanning line 4, the each of signals which is associated with a corresponding one of the data lines 51, 52, and 53 is retained by a corresponding one of the parasitic capacitances.

Through such a configuration described above, the electrophoretic apparatus 1 makes it possible to decrease the number of the data lines 5 connected to each pixel 2. Specifically, through such a configuration described above, the electrophoretic apparatus 1 makes it possible to decrease the number of the data lines 5 connected to each pixel 2 from three to one.

Figure 9:
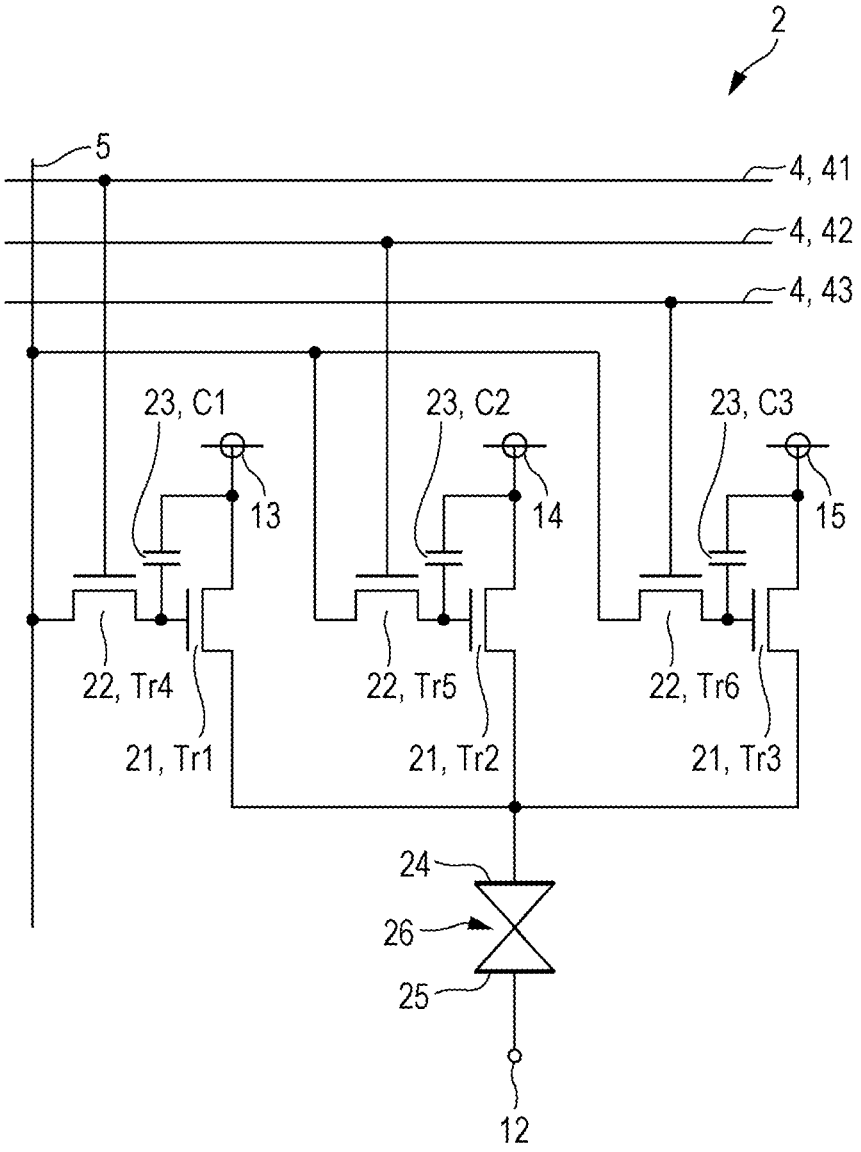
FIG. 9 is a block diagram illustrating a second modification example of a circuit configuration of a pixel according to an embodiment of the invention.

Further, the electrophoretic apparatus 1 according to this embodiment can be also configured in a manner shown in FIG. 9.

FIG. 9 is a block diagram illustrating a second modification example of a configuration of a circuit of each pixel 2. In this modification example, a plurality of scanning lines 4 (whose number is, for example, three) and one data line 5 are connected to each pixel 2. In this example, the scanning lines 4 include scanning lines 41, 42, and 43. That is, this configuration is different from that of the aforementioned embodiment in a respect that, in substitution for the plurality of data lines 5, the plurality of scanning lines 4 are connected to the pixel 2. During a program period, the controller 9 makes the scanning line 41 "H" in the state in which the data line 5 is made "H" or "L". Through this operation, the transistor Tr1 is programmed into ON state or OFF state. Further, during the program period, the controller 9 makes the scanning line 42 "H" in the state in which the data line 5 is made "H" or "L". Through this operation, the transistor Tr2 is programmed into ON state or OFF state. Similarly, during the program period, the controller 9 makes the scanning line 43 "H" in the state in which the data line 5 is made "H" or "L". Through this operation, the transistor Tr3 is programmed into ON state or OFF state.

Through such a configuration described above, the electrophoretic apparatus 1 makes it possible to reduce a degree of blurring in display of each pixel 2 due to a variation of each of electric potentials of the each pixel 2, which is caused by electric potentials of a pixel 2 adjacent to the each pixel 2.

Figure 10A:
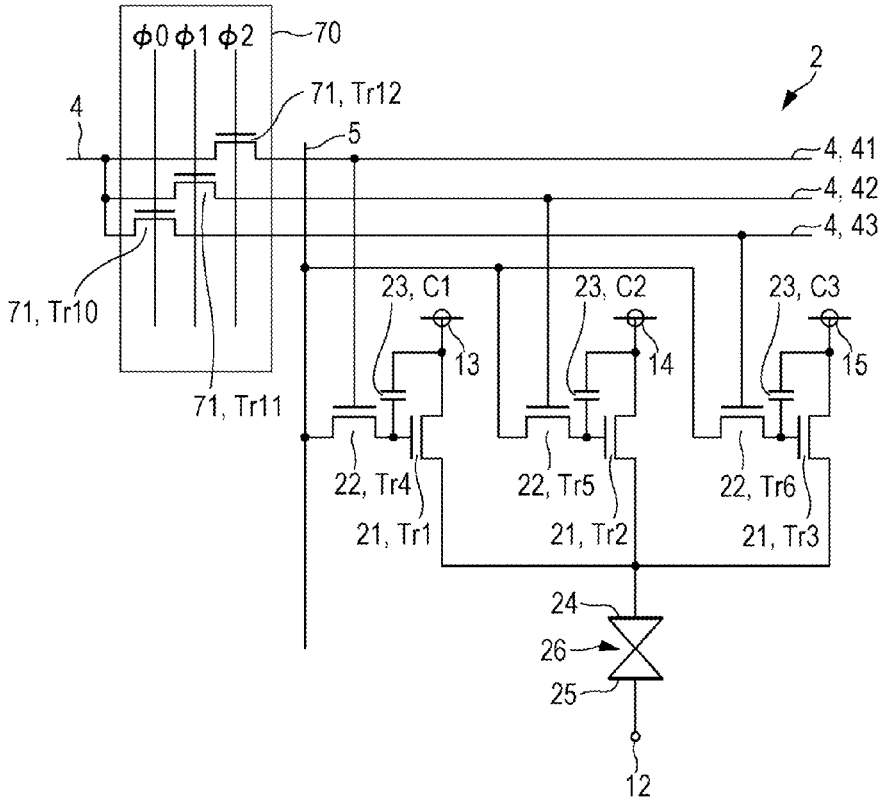
FIG. 10A and FIG. 10B are a block diagram and a timing diagram, respectively, which illustrate a third modification example of a circuit configuration of a pixel according to an embodiment of the invention.
Figure 10B:
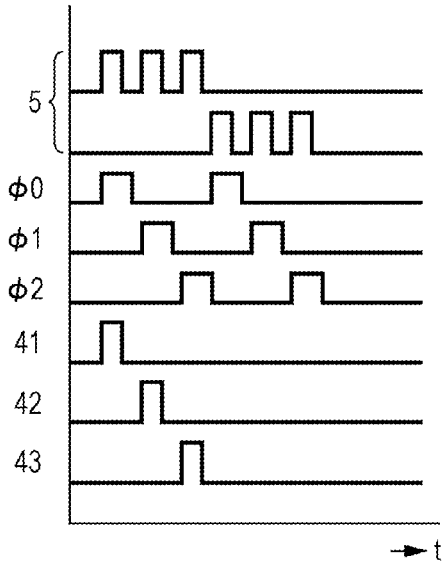

Further, the electrophoretic apparatus 1 having been shown in the second modification example can be also configured in a manner shown in FIGS. 10A and 10B.

FIG. 10A is a block diagram illustrating a third modification example of the circuit configuration of each pixel 2. In this modification example, as shown in FIG. 10A, a plurality of scanning lines 4 (whose number is, for example, three) and one data line 5 are connected to each pixel 2. Further, the pixel 2 includes a scanning line demultiplexing circuit 70. This scanning line demultiplexing circuit 70 generates signals each associated with a corresponding one of scanning lines 41, 42, and 43 by demultiplexing the signals which are time division multiplexed on one scanning line 4. Specifically, the scanning line demultiplexing circuit 70 includes demultiplexing transistors 71. The demultiplexing transistors 71 include transistors Tr10, Tr11, and Tr12. The transistor Tr10 has ON and OFF states which are switched to each other in accordance with an electric potential of a control line φ0 which is connected to the controller 9. Further, the transistor Tr11 has ON and OFF states which are switched to each other in accordance with an electric potential of a control line φ1 which is connected to the controller 9. Further, the transistor Tr12 has ON and OFF states which are switched to each other in accordance with an electric potential of a control line φ2 which is connected to the controller 9. The controller 9 performs control of electric potentials each associated with a corresponding one of the control lines φ0, φ1, and φ2, the data line 5, and the scanning lines 4 in accordance with timing shown in FIG. 10B.

Through this configuration, as compared with the case of the above-described second modification example, the electrophoretic apparatus 1 makes it possible to make the number of the scanning lines 4 connected to each pixel 2 smaller. Specifically, through this configuration, the electrophoretic apparatus 1 makes it possible to decrease the number of the scanning lines 4 from three to one.

Figure 11A:
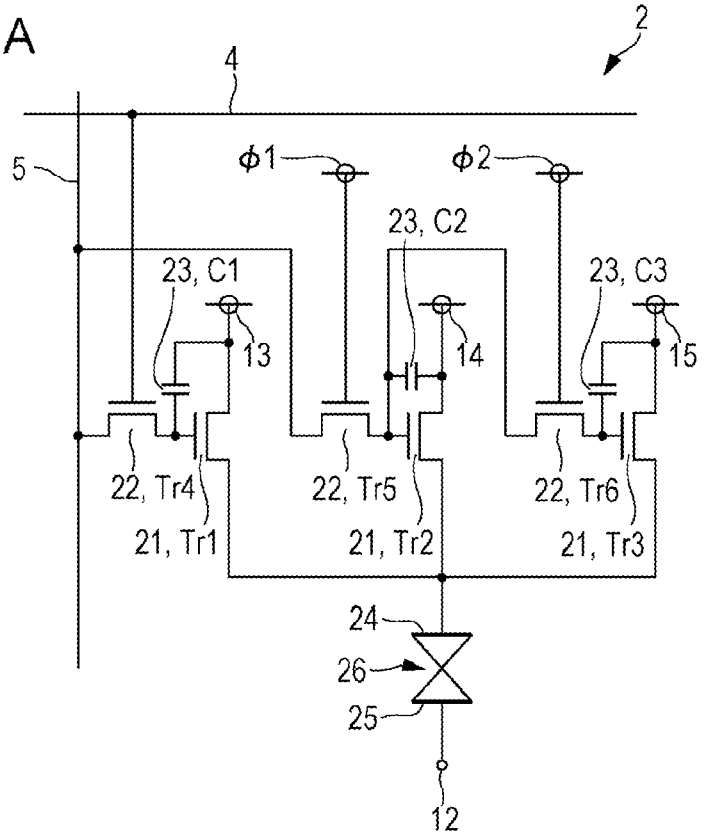
FIG. 11A and FIG. 11B are a block diagram and a timing diagram, respectively, which illustrate a fourth modification example of a circuit configuration of a pixel according to an embodiment of the invention.
Figure 11B:
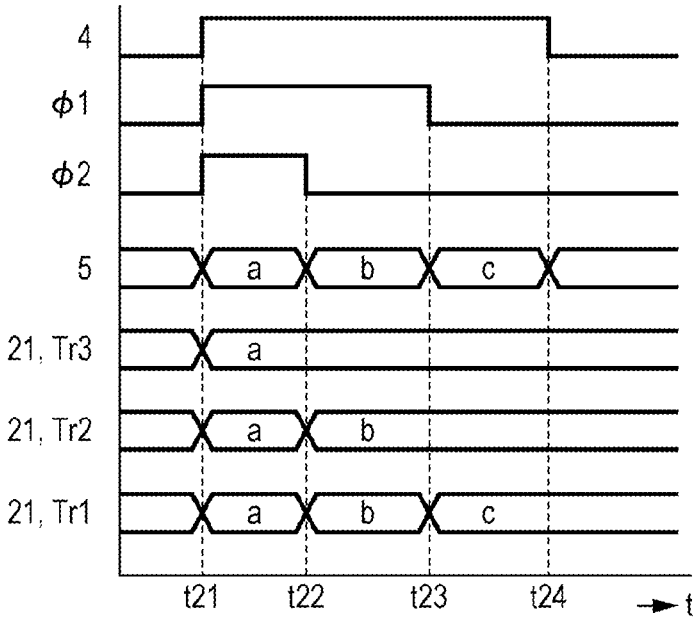

Further, the electrophoretic apparatus 1 can be configured in a manner shown in FIGS. 11A and 11B.

FIG. 11A is a block diagram illustrating a fourth modification example of the circuit configuration of each pixel 2. In this modification example, as shown in FIG. 11A, one scanning line 4, one data line 5, and control lines φ1 and φ2 are connected to each pixel 2. That is, this configuration is different from that of each of the aforementioned embodiment and modification examples in a respect that the number of the scanning data lines 4 connected to the pixel 2 as well as the number of the data lines 5 connected to the pixel 2 is just one. The controller 9 performs control of electric potentials of the control lines φ1 and φ2, in addition to electric potentials of the scanning line 4 and the data line 5. Specifically, the controller 9 performs control of electric potentials each associated with a corresponding one of the control lines φ1 and φ2, the data line 5, and the scanning line 4. That is, as shown in FIG. 11B, during a period from a time point t21 until a time point t22, in the state in which the data line 5 is made "H" or "L", the controller 9 makes each of the scanning line 4 and the control lines φ1 and φ2 "H". Through this operation, each of the transistors Tr1, Tr2, and Tr3 is programmed into ON state or OFF state. Next, during a period from the time point t22 until a time point t23, in the state in which the data line 5 is made "H" or "L", the controller 9 makes each of the scanning line 4 and the control line φ1 "H". At this time, the controller 9 makes the control line φ2 "L". Through this operation, the state of the transistor Tr3 is not changed, and each of the transistors Tr1 and Tr2 is programmed into ON state or OFF state. Next, during a period from the time point t23 until a time point t24, in the state in which the data line 5 is made "H" or "L", the controller 9 makes the scanning line 4 "H". At this time, the controller 9 makes each of the control lines φ1 and φ2 "L". Through this operation, the state of each of the transistors Tr2 and Tr3 is not changed, and the transistor Tr1 is programmed into ON state or OFF state.

Through such a configuration described above, the electrophoretic apparatus 1 makes it possible to reduce a degree of blurring in display of each pixel 2 due to a variation of each of electric potentials of the each pixel 2, which is caused by electric potentials of a pixel 2 adjacent to the each pixel 2.

MODIFICATION EXAMPLE 2

Heretofore, the description has been made supposing that the data lines 5 includes the data lines 51, 52, and 53, which are connected to each pixel, but the invention is not limited to this configuration. In this modification example 2, a case where, in substitution for the data lines 5, data lines 500 are connected to each pixel 200 will be described with reference to FIGS. 12 and 13. These data lines 500 include data lines 520 and 530. This data line 520 corresponds to the aforementioned data line 52. Further, the data line 530 corresponds to the aforementioned data line 53. That is, this configuration is different from that of each of the aforementioned embodiment and modification examples in a respect that a data line corresponding to the aforementioned data line 51 is not included in the data lines 500. In addition, a portion having the same configuration as that of a portion of the aforementioned embodiment will be denoted by the same reference sign as that of the portion of the aforementioned embodiment, and description thereof is omitted here.

Figure 12:
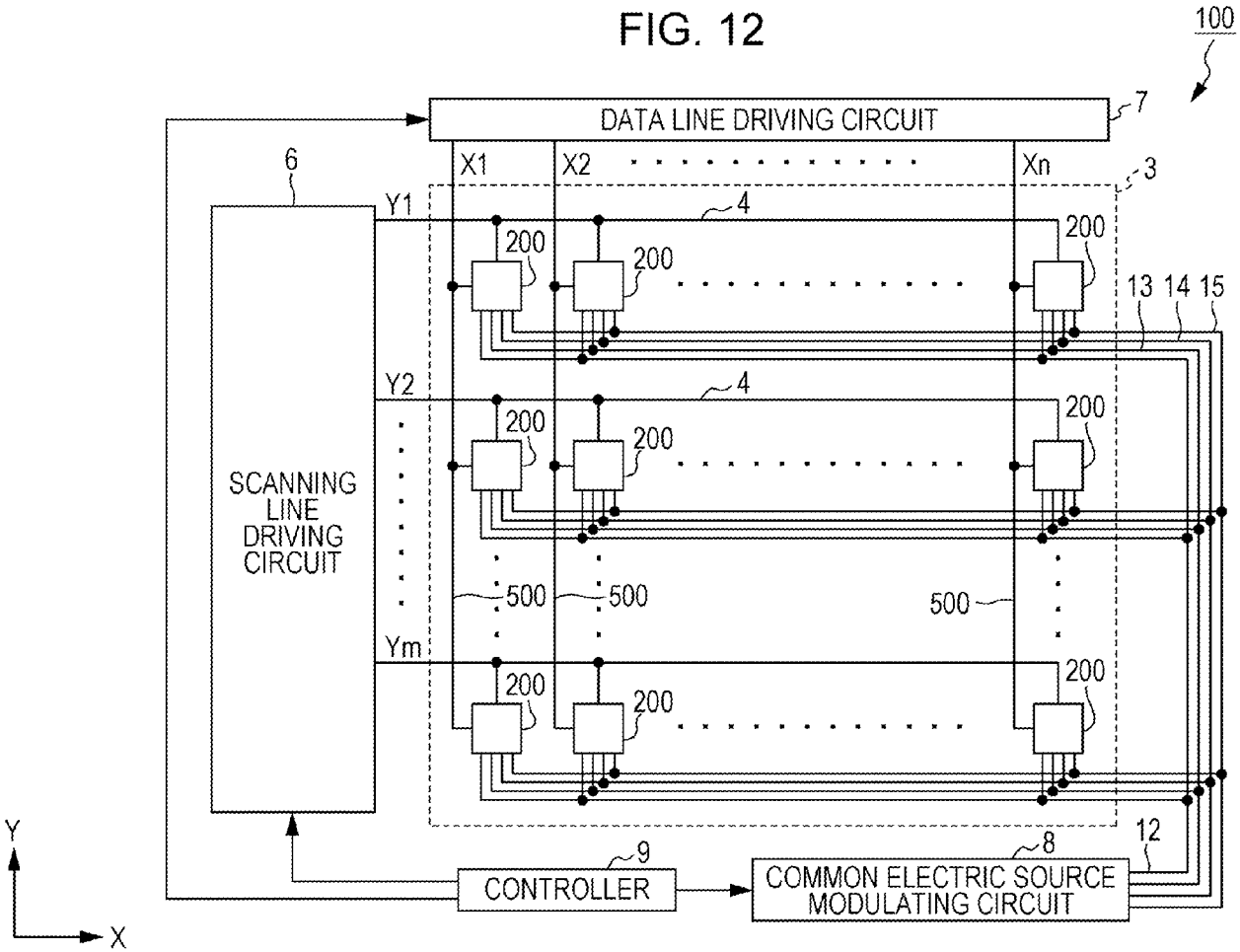
FIG. 12 is a block diagram illustrating an outline of a configuration of an electrophoretic apparatus in a modification example of an embodiment of the invention.

FIG. 12 is a block diagram illustrating an outline of a configuration of an electrophoretic apparatus 100 in this modification example. The electrophoretic apparatus 100 includes pixels 200 in substitution for the pixels 2. Each of the pixels 200 is connected to the data line 520 and the data line 530. A specific example of a configuration of this pixel 200 will be described with reference to FIG. 13.

Figure 13:
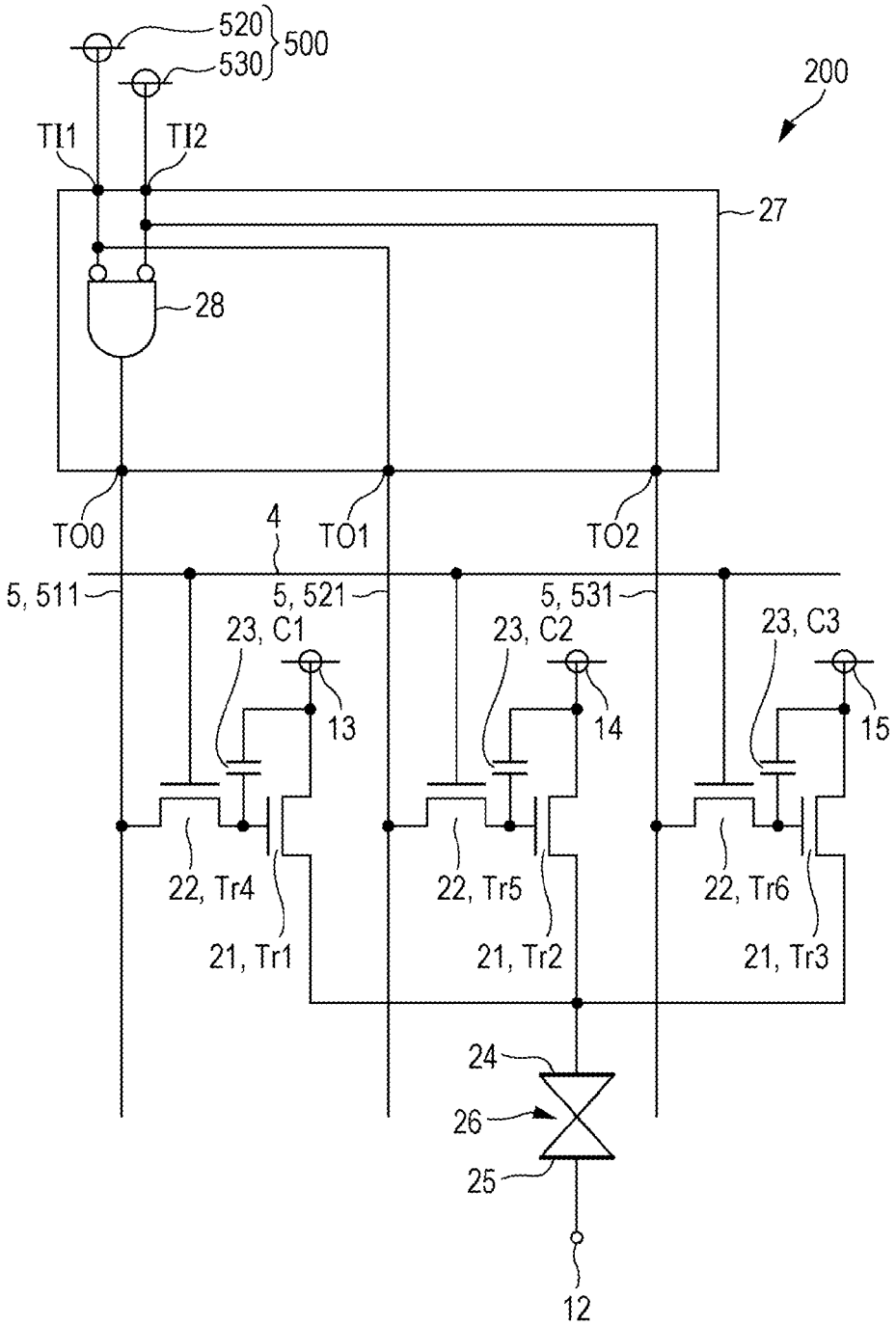
FIG. 13 is a block diagram illustrating an example of a circuit configuration of a pixel of an electrophoretic apparatus in a modification example of an embodiment of the invention.

FIG. 13 is a block diagram illustrating an example of a circuit configuration of each pixel 200 of the electrophoretic apparatus 100 in this modification example. The pixel 200 is different from the pixel 2 in a respect that the pixel 200 includes an image data electric potential generation circuit 27.

In this example, the image data electric potential generation circuit 27 includes an inverted AND circuit 28 having two inputs. The image data electric potential generation circuit 27 includes two input terminals and three output terminals. Specifically, the image data electric potential generation circuit 27 includes input terminals TI1 and TI2 and output terminals TO0, TO1, and TO2.

The input terminal TI1 is connected to the data line 520. The input terminal TI2 is connected to the data line 530.

At the output terminal TO1, an image data electric potential supplied to the input terminal TI1 from the data line 520 is output as it is. As described above, the image data electric potential has two electric potential levels. A higher one of the two electric potential levels is "H", and a lower one of the two electric potential levels is "L". When an image data electric potential supplied to the input terminal TI1 from the data line 520 is "H", "H" is output at the output terminal TO1. Further, when an image data electric potential supplied to the input terminal TI1 from the data line 520 is "L", "L" is output at the output terminal TO1.

At the output terminal TO2, an image data electric potential supplied to the input terminal TI2 from the data line 530 is output as it is. When an image data electric potential supplied to the input terminal TI2 from the data line 530 is "H", "H" is output at the output terminal TO2. Further, when an image data electric potential supplied to the input terminal TI2 from the data line 530 is "L", "L" is output at the output terminal TO2.

The inverted AND circuit 28 has input terminals each connected to a corresponding one of the input terminals TI1 and TI2, as well as an output terminal connected to the output terminal TO0. That is, an electric potential resulting from logical addition of an electric potential resulting from inverting an image data electric potential supplied to the input terminal TI1 and an electric potential resulting from inverting an image data electric potential supplied to the input terminal TI2 is output at the output terminal TO0.

Specifically, when an image data electric potential supplied to the input terminal TI1 is "H" and an image data electric potential supplied to the input terminal TI2 is "H", "L" is output at the output terminal TO0. Further, when an image data electric potential supplied to the input terminal TI1 is "L" and an image data electric potential supplied to the input terminal TI2 is "H", "L" is output at the output terminal TO0. Further, when an image data electric potential supplied to the input terminal TI1 is "H" and an image data electric potential supplied to the input terminal TI2 is "L", "L" is output at the output terminal TO0. Further, when an image data electric potential supplied to the input terminal TI1 is "L" and an image data electric potential supplied to the input terminal TI2 is "L", "H" is output at the output terminal TO0. That is, only when the data line 520 is "L" and the data line 530 is "L", "H" is output at the output terminal TO0.

The source terminal of the transistor Tr4 is connected to the data line 511 which is connected to the output terminal TO0. That is, the source terminal of the transistor Tr4 is supplied with an output electric potential of the inverted AND circuit 28. In other words, the source terminal of the transistor Tr4 is supplied with an image data electric potential which is generated by the image data electric potential generation circuit 27 on the basis of an image data electric potential supplied from the data line 520 and an image data electric potential supplied from the data line 530. The source terminal of the transistor Tr5 is connected to the data line 521 which is connected to the output terminal TO1. That is, the source terminal of the transistor Tr5 is supplied with an image data electric potential supplied from the data line 520. The source terminal of the transistor Tr6 is connected to the data line 531 which is connected to the output terminal TO2. That is, the source terminal of the transistor Tr6 is supplied with an image data electric potential supplied from the data line 530.

Each pixel 200 makes its display state a white display state or a black display state on the basis of an image data electric potential supplied from the data line 520, an image data electric potential supplied from the data line 530, and an image data electric generated by the image data electric potential generation circuit 27.

As described above, the electrophoretic apparatus 100 generates an image data electric potential corresponding to that supplied from the data line 51 included in the aforementioned electrophoretic apparatus 1 by using the image data electric potential generation circuit 27 included in each pixel 200. Thus, the electrophoretic apparatus 100 is capable of performing the same operation as that of the electrophoretic apparatus 1 even though the electrophoretic apparatus 100 is not provided with the data line 51 included in the aforementioned electrophoretic apparatus 1. Accordingly, the electrophoretic apparatus 100 brings about the same advantageous effect as that of the electrophoretic apparatus 1. That is, the electrophoretic apparatus 100 makes it possible to reduce a degree of blurring in display of each pixel 200 due to a variation of each of electric potentials of the each pixel 200, which is caused by electric potentials of a pixel 200 adjacent to the each pixel 200.

Further, the electrophoretic apparatus 100 does not include the data line 51, and thus, the number of data lines connected to each pixel 200 can be reduced from three to two. That is, the electrophoretic apparatus 100 makes it possible to decrease a size of a piece of image data written into each pixel 200 from three bits to two bits. Through this configuration, the electrophoretic apparatus 100 makes it possible to reduce time for transferring image data as well as power consumption.

Electronic Device

Figure 14A:
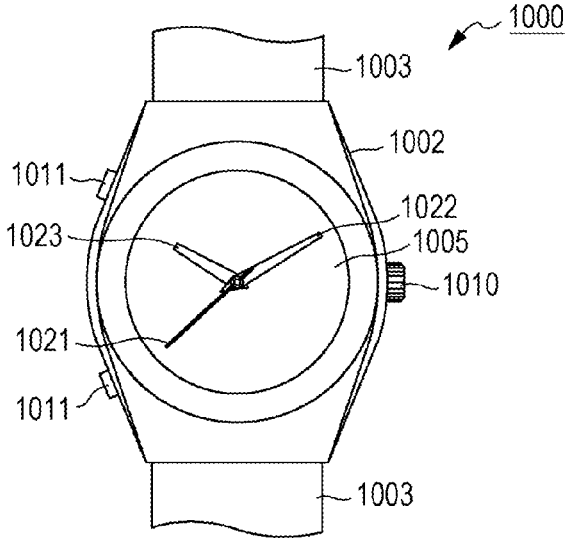
FIGS. 14A, 14B, and 14C are diagrams each illustrating an example of electronic devices according to the invention.
Figure 14B:
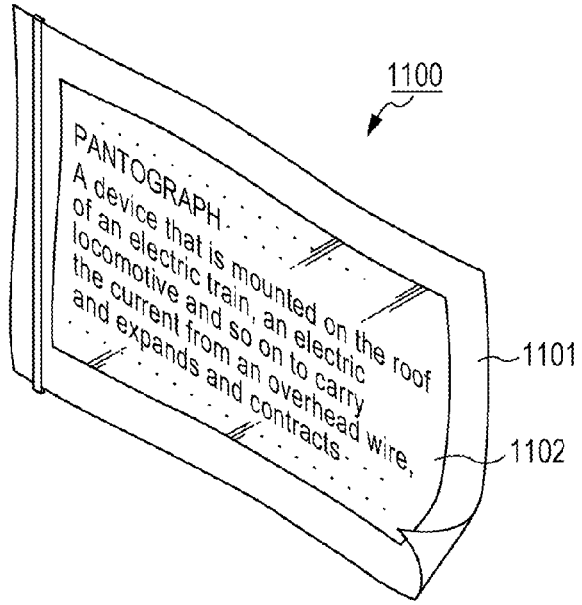
Figure 14C:
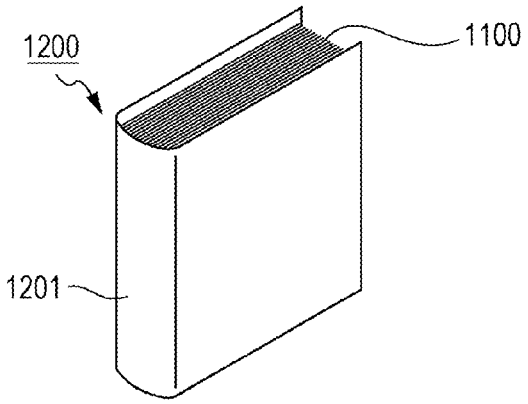

Next, some cases in each of which an electrophoretic apparatus according to the invention is applied to an electronic device will be described. FIGS. 14A, 14B, and 14C are diagrams each illustrating an example of an electronic device to which the electronic apparatus 1 according to the aforementioned embodiment is applied.

FIG. 14A is a front view of a wrist watch 1000 which is an example of such an electronic device. The wrist watch 1000 includes a watch case 1002 and a pair of bands 1003 which are connected to the watch case 1002.

There are provided a display portion 1005 including an electrophoretic apparatus according to the invention, a second hand 1021, a minute hand 1022, and an hour hand 1023 on a front face of the watch case 1002, and there are provided a winder 1010 as an operation element as well as an operation button 1011 on a side face of the watch case 1002. The winder 1010 is connected to a winding stem (omitted from illustration) provided inside the case, and is provided integrally with the winder so as to be pushable/pullable across multiple steps (for example, two steps) and be rotatable.

On the display portion 1005, an image as a background and character strings indicating a date, a clock time and the like, or a second hand, a minute hand, an hour hand and the like, can be displayed by means of a driving method implemented in the electrophoretic apparatus according to the invention, which is included in the display portion 1005.

Providing an electrophoretic apparatus according to the invention as the display portion 1005 makes it possible to cause rewriting of the contents of display in the display portion 1005 to appear as if the rewriting is simultaneously carried out and, as a result, enables realization of optimum display in the wrist watch 1000.

FIG. 14B is a perspective view illustrating a configuration of electronic paper 1100. The electronic paper 1100 includes a body 1101, which has flexibility and is formed of a rewritable sheet having texture and bendability similar to those of a sheet of existing general paper, as well as a display portion 1102 constituted by an electrophoretic apparatus according to the invention. This electronic paper 1100 is made possible to perform rewriting in an optimum manner by employing the driving method implemented in the electrophoretic apparatus 1 according to the aforementioned embodiment.

FIG. 14C is a perspective view illustrating an electronic notebook 1200 which is an example of such an electronic device. The electronic notebook 1200 is an electronic device which is configured such that a plurality of sheets of the electronic paper 1100 shown in FIG. 14B is bundled, and is bound by a cover 1201. The cover 1201 includes, for example, a display data input means (omitted from illustration) for inputting display data transmitted from an external device. Through this configuration, the contents of display can be changed or updated in accordance with the display data, in the state in which the sheets of the electronic paper remain bundled.

Providing the electrophoretic apparatus 1 according to the aforementioned embodiment in the electronic paper 1100 and the electronic notebook 1200 makes it possible to cause rewriting of the contents of display to appear as if the rewriting is simultaneously carried out, and, as a result, enables realization of optimum display in the electronic paper 1100 and the electronic notebook 1200.

In addition, the electronic devices shown in FIGS. 14A, 14B, and 14C are just examples of an electronic device according to the invention, and do not limit a technical scope of the invention. For example, an electrophoretic apparatus according to the invention can be also suitably applied to a display area of each of electronic devices, such as a mobile-phone and a portable audio device, in addition to the electric paper 1100 and the electric note 1200.

This application makes it possible to cause rewriting of contents of display in such an electronic device to appear as if the rewriting is simultaneously carried out, and, as a result, enables realization of optimum display in the electronic device.

According the aforementioned embodiment, as described above, electric potentials of each of pixels constituting the electrophoretic apparatus included in each of the above electronic devices are stable, and thus, each of the above electronic devices makes it possible to reduce a degree of a variation of each of the electric potentials of the each pixel, which is caused by electric potentials of a pixel adjacent to the each pixel. Thus, each of the above electronic devices makes it possible to reduce a degree of blurring in display of each pixel due to a variation of each of electric potentials of the each pixel, which is caused by electric potentials of a pixel adjacent to the each pixel.

In addition, in the aforementioned embodiment, a case where each of the white particles 262 is charged to a positive (+) electric potential and each of the black particles 263 is charged to a negative (−) electric potential has been described, but the invention is not limited to the aforementioned embodiment which is just an embodiment in which the invention is embodied. A case where each of the white particles 262 and the black particles 263 is charged to a polarity invers to the above polarity, that is, each of the white particles 262 is charged to the negative (−) electric potential and each of the black particles 263 is charged to the positive (+) electric potential can be also dealt with by employing a configuration and a method similar to those of the aforementioned embodiment.

Further, in the aforementioned embodiment, there has been described the electrophoretic apparatus 1 which performs so-called monochrome display using the white particles 262 and the black particles 263, and having display states including two display states, one being a white display state, the other one being a black display state, and gray display states being intermediate grayscale display states between the black display state and the white display state, and including a dark gray (DG) display state and a light gray (LG) display state. The invention, however, is not limited to the aforementioned embodiment which is just an embodiment in which the invention is embodied, and a driving method implemented in an electrophoretic apparatus according to the invention can be also applied to an electrophoretic apparatus which becomes capable of displaying, for example, a red color, a green color, a blue color, or the like, by replacing each of two kinds of pigments for the white particles 262 and the black particles 263 with a red pigment, a green pigment, a blue color, or the like.

Summary of Embodiment Described Above

Hereinbefore, an embodiment of the invention has been described in detail with reference to drawings, but specific configurations are not limited to the embodiment. Further, designs or the like within a scope not departing from the gist of the invention are also included in the invention.

In addition, a program for realizing functions of any desired constituent portions of the apparatus having been described above may be recorded in a computer readable recording medium. Further, the program may be loaded into a computer system from the recording medium and may be executed by the computer system. In addition, it is supposed that the "computer system" described here includes an operating system (OS) and hardware components, such as peripheral devices. Further, the "computer readable recording medium" means a portable medium, such as a flexible disk, a magneto optical disk, a read only memory (ROM), or a compact disk (CD)-ROM, or a storage device incorporated in the computer system, such as a hard disk. Moreover, it is supposed that the "computer readable recording medium" also includes a device, such as a volatile random access memory (RAM), which retains the program for a constant period of time and which is included in a computer system serving as a server or a client in the case where the program is transmitted via a network, such as the Internet or a telephone line.

Further, the above program may be transmitted from a computer system, in which the program is stored in a storage device or the like, to a different computer system via a transmission medium or a transmission wave included in a transmission medium. Here, the "transmission medium", via which the program is transmitted, means a medium having a function of transmitting information, just like a communication link (a communication line), such as a telephone line, or a network (a communication network), such as the Internet.

Further, the above program may be a program which realizes a portion of the aforementioned functions. Moreover, the above program may be a so-called difference file (a difference program) which can realize the aforementioned functions by being combined with a program which is already recorded in the computer system.

The entire disclosure of Japanese Patent Application Nos. 2014-045633, filed Mar. 7, 2014 and 2014-251917, filed Dec. 12, 2014 are expressly incorporated by reference herein.

What is claimed is:

1. An electrophoretic apparatus comprising:

a plurality of pixels including a first electrode, a second electrode opposite the first electrode, an electrophoretic element which is interposed between the first electrode and the second electrode and which includes a plurality of charged electrophoretic particles, and a pixel circuit which is connected to a scanning line and a data line and gives an electric potential difference between the first electrode and the second electrode, wherein the pixel circuit includes:

a first transistor configured to control whether a first electric potential is to be supplied to the first electrode, or not, on the basis of a signal supplied to the first transistor through the data line, a second transistor configured to control whether or not a second electric potential, which is different from the first electric potential, is to be supplied to the first electrode, or not, on the basis of a signal supplied to the second transistor through the data line, a third transistor configured to control whether a third electric potential, which is different from the first electric potential and the second electric potential, is to be supplied to the first electrode, or not, on the basis of a signal supplied to the third transistor through the data line, a fourth transistor configured to control whether a signal supplied to the fourth transistor through the data line is to be supplied to the first transistor, or not, on the basis of a signal supplied to the fourth transistor through the scanning line, a fifth transistor configured to control whether a signal supplied to the fifth transistor through the data line is to be supplied to the second transistor, or not, on the basis of a signal supplied to the fifth transistor through the scanning line, and a sixth transistor configured to control whether a signal supplied to the sixth transistor through the data line is to be supplied to the third transistor, or not, on the basis of a signal supplied to the sixth transistor through the scanning line, and wherein a drain terminal of the fourth transistor is directly connected to a gate terminal of the first transistor, a drain terminal of the fifth transistor is directly connected to a gate terminal of the second transistor, and a drain terminal of the sixth transistor is directly connected to a gate terminal of the third transistor.

2. The electrophoretic apparatus according to claim 1, wherein the first electric potential is an electric potential which, when supplied to the first electrode, causes the plurality of charged electrophoretic particles not to be electrophoresed between the first electrode and the second electrode, the second electric potential is an electric potential which, when supplied to the first electrode, causes electrophoretic particles that are included in the plurality of charged electrophoretic particles and that are charged to a positive electric potential to be electrophoresed toward a side of the first electrode, and the third electric potential which, when supplied to the first electrode, causes electrophoretic particles that are included in the plurality of charged electrophoretic particles and that are charged to a positive electric potential to be electrophoresed toward a side of the second electrode.

3. An electronic device comprising the electrophoretic apparatus according to claim 2.

4. The electrophoretic apparatus according to claim 1, wherein the plurality of pixels further includes a first capacitor which, when any signal is not supplied to the first transistor through the data line, retains a gate electric potential of the first transistor, a second capacitor which, when any signal is not supplied to the second transistor through the data line, retains a gate electric potential of the second transistor, and a third capacitor which, when any signal is not supplied to the third transistor through the data line, retains a gate electric potential of the third transistor.

5. An electronic device comprising the electrophoretic apparatus according to claim 4.

6. The electrophoretic apparatus according to claim 1, wherein the data line includes a first data line, a second data line, and a third data line;

the first transistor controls whether the first electric potential is to be supplied to the first electrode, or not, on the basis of a signal supplied to the first transistor though the first data line;

the second transistor controls whether the second electric potential is to be supplied to the first electrode, or not, on the basis of a signal supplied to the second transistor through the second data line, and the third transistor controls whether the third electric potential is to be supplied to the first electrode, or not, on the basis of a signal supplied to the third transistor through the third data line.

7. An electronic device comprising the electrophoretic apparatus according to claim 6.

8. The electrophoretic apparatus according to claim 1, wherein the scanning line includes a first scanning line, a second scanning line, and a third scanning line;

the fourth transistor controls whether the signal supplied to the fourth transistor through the data line is to be supplied to the first transistor, or not, on the basis of a signal supplied to the fourth transistor through the first scanning line;

the fifth transistor controls whether the signal supplied to the fifth transistor through the data line is to be supplied to the second transistor, or not, on the basis of a signal supplied to fifth transistor through the second scanning line; and the sixth transistor controls whether the signal supplied to the sixth transistor through the data line is to be supplied to the third transistor, or not, on the basis of a signal supplied to the sixth transistor through the third scanning line.

9. An electronic device comprising the electrophoretic apparatus according to claim 8.

10. An electronic device comprising the electrophoretic apparatus according to claim 1.

* * * * *